US009096970B2

(12) United States Patent
Ko et al.

(10) Patent No.: US 9,096,970 B2
(45) Date of Patent: Aug. 4, 2015

(54) CLOTHES TREATING APPARATUS

(75) Inventors: Hyojin Ko, Seoul (KR); Sangik Lee, Seoul (KR); Donghyun Kim, Seoul (KR); Seungphyo Ahn, Seoul (KR); Jeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1042 days.

(21) Appl. No.: 13/100,455

(22) Filed: May 4, 2011

(65) Prior Publication Data

US 2011/0271542 A1 Nov. 10, 2011

(30) Foreign Application Priority Data

| | | |
|---|---|---|
| May 4, 2010 | (KR) | 10-2010-0042001 |
| May 4, 2010 | (KR) | 10-2010-0042002 |
| May 4, 2010 | (KR) | 10-2010-0042003 |
| May 7, 2010 | (KR) | 10-2010-0042763 |
| May 7, 2010 | (KR) | 10-2010-0042795 |
| May 7, 2010 | (KR) | 10-2010-0042797 |
| May 7, 2010 | (KR) | 10-2010-0042798 |
| Sep. 3, 2010 | (KR) | 10-2010-0086350 |

(51) Int. Cl.
*D06F 58/22* (2006.01)
*D06F 58/28* (2006.01)

(52) U.S. Cl.
CPC ..... *D06F 58/22* (2013.01); *D06F 58/28* (2013.01); *D06F 2058/2854* (2013.01)

(58) Field of Classification Search
CPC .. D06F 58/22; D06F 58/28; D06F 2058/2854
USPC ..... 34/72, 79, 82, 85, 524
See application file for complete search history.

(56) References Cited

U.S. PATENT DOCUMENTS

| | | | |
|---|---|---|---|
| 4,314,409 | A | 2/1982 | Cartier |
| 5,701,684 | A | 12/1997 | Johnson |
| 8,438,750 | B2 | 5/2013 | Dittmer |
| 2006/0201014 | A1 | 9/2006 | Favret |
| 2008/0196268 | A1 | 8/2008 | Jung |

(Continued)

FOREIGN PATENT DOCUMENTS

| | | | |
|---|---|---|---|
| DE | 4403183 | A1 | 8/1995 |
| DE | 10-2006060031 | A1 | 6/2008 |

(Continued)

OTHER PUBLICATIONS

English translation of KR 10-0853332 Aug. 21, 2008.*

(Continued)

*Primary Examiner* — Jiping Lu
(74) *Attorney, Agent, or Firm* — Fish & Richardson P.C.

(57) ABSTRACT

An apparatus for treating clothes includes an accommodating space, an air supply unit, a duct unit, a filter unit, a substance removal unit and a collection unit that is separate from the filter unit and the substance removal unit. The accommodating space is configured to receive one or more clothing articles. The air supply unit is configured to supply air to the accommodating space. The duct unit is configured to guide discharge of air from the accommodating space. The filter unit is positioned to filter substances from air discharged from the accommodating space through the duct unit. The substance removal unit is configured to move substances remaining on a portion of the filter unit. The collection unit is configured to collect substances moved from the filter unit by the substance removal unit.

14 Claims, 20 Drawing Sheets

(56) References Cited

U.S. PATENT DOCUMENTS

| | | | | |
|---|---|---|---|---|
| 2009/0151191 | A1* | 6/2009 | Grunert | 34/480 |
| 2011/0167662 | A1 | 7/2011 | Dittmer | |

FOREIGN PATENT DOCUMENTS

| | | | |
|---|---|---|---|
| DE | 102006060031 | A1 | 6/2008 |
| EP | 1 719 833 | A1 | 11/2006 |
| EP | 2 146 000 | A1 | 1/2010 |
| EP | 02226421 | A1 | 9/2010 |
| EP | 02341182 | A1 | 7/2011 |
| JP | 06-098993 | A | 4/1994 |
| JP | 2009-279080 | A | 12/2009 |
| JP | 2009-279081 | A | 12/2009 |
| JP | 2009-285237 | A | 12/2009 |
| KR | 10-0853332 | A | 8/2008 |
| KR | 10-2009-0102415 | | 9/2009 |
| KR | 10-2011-0122463 | A | 11/2011 |
| KR | 10-2011-0122464 | A | 11/2011 |
| KR | 10-2011-0122466 | A | 11/2011 |
| WO | WO 2008/074581 | A1 | 6/2008 |
| WO | WO 2010/028992 | A1 | 3/2010 |

OTHER PUBLICATIONS

Russian Office Action dated Feb. 7, 2014 for Application No. 2012149220, with English Translation, 8 pages.

PCT International Search Report and Written Opinion dated Nov. 15, 2011 for Application No. PCT/KR2011/003346, 14 pages.

European Search Report dated Dec. 16, 2013, for Application No. 11777576.7, 6 pages.

Chinese Office Action dated Jul. 28, 2014 for Chinese Application No. 201180022453.9, with English Translation, 14 Pages.

Korean Notice of Allowance (Appln. No. 10-2010-0042001) dated Jul. 25, 2012, 3 pages, with English Translation.

Korean Notice of Allowance (Appln. No. 10-2010-0042002) dated Jul. 25, 2012, 3 pages, with English Translation.

* cited by examiner (a)

(b)

(a)

(b)

(a)

(b)

CLOTHES TREATING APPARATUS

CROSS REFERENCE TO RELATED APPLICATIONS

Pursuant to 35 U.S.C. §119(a), this application claims the benefit of the Korean Patent Application No. 10-2010-0042001 filed on May 4, 2010, the Korean Patent Application No. 10-2010-0042763 filed on May 7, 2010, the Korean Patent Application No. 10-2010-0042003 filed on May 4, 2010, the Korean Patent Application No. 10-2010-0042002 filed on May 4, 2010, the Korean Patent Application No. 10-2010-0042795 filed on May 7, 2010, the Korean Patent Application No. 10-2010-0042797 filed on May 7, 2010, the Korean Patent Application No. 10-2010-0042798 filed on May 7, 2010 and the Korean Patent Application No. 10-2010-0086350 filed on Sep. 3, 2010 all of which are incorporated herein by reference in their entirety.

TECHNICAL FIELD

The following disclosure relates generally to a clothes treating apparatus.

BACKGROUND

In general, clothes treatment apparatus are electric appliances used to perform washing, drying or both washing and drying of clothes. Clothes treatment apparatus include washing machines, dryers and machines having both washing and drying functions. In a conventional clothes treating apparatus capable of drying clothes, it may be necessary to remove foreign substances, such as lint, from the discharged air. Therefore, it may be desirable to filter air discharged from a clothes treating apparatus capable of drying clothes.

SUMMARY

Figure 1:
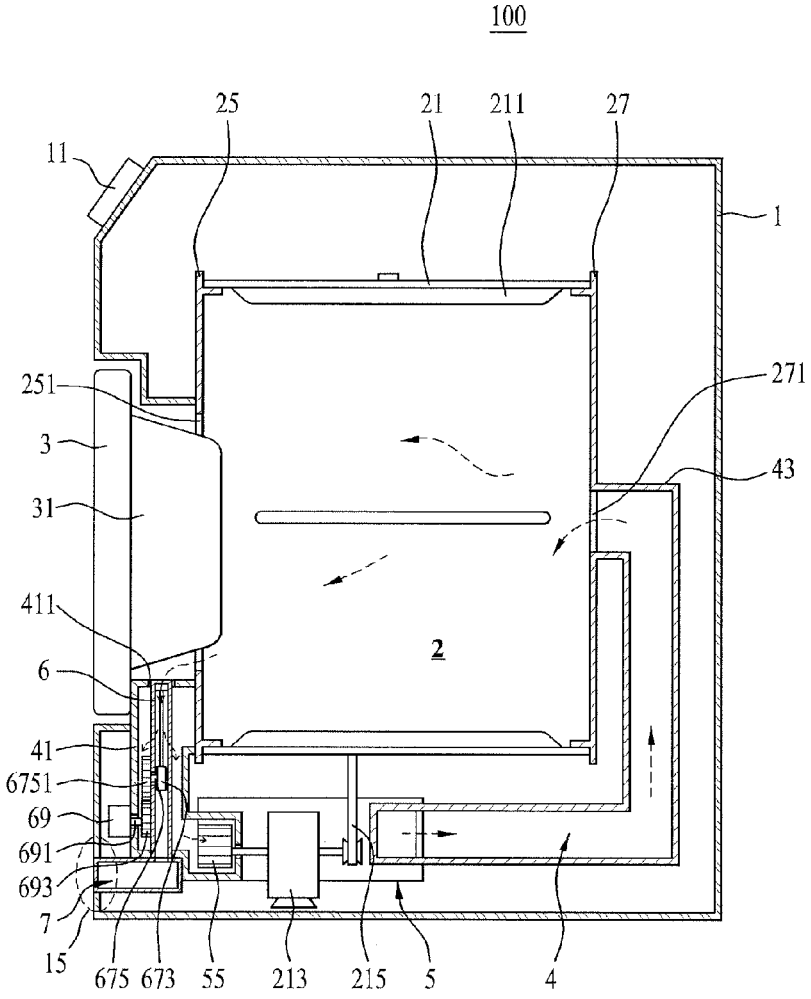
FIG. 1 illustrates an example clothes treating apparatus.

In a general aspect, an apparatus for treating clothes includes an accommodating space, an air supply unit, a duct unit, a filter unit, a substance removal unit and a collection unit that is separate from the filter unit and the substance removal unit. The accommodating space is configured to receive one or more clothing articles. The air supply unit is configured to supply air to the accommodating space. The duct unit is configured to guide discharge of air from the accommodating space. The filter unit is positioned to filter substances from air discharged from the accommodating space through the duct unit. The substance removal unit is configured to move substances remaining on a portion of the filter unit. The collection unit is configured to collect substances moved from the filter unit by the substance removal unit.

Particular implementations may include one or more of the following features. For example, the apparatus for treating clothes also may include a compression unit that is configured to compress substances collected in the collection unit. The substance removal unit may include a rotating brush. The compression unit may include a plate configured to move in the collection unit along a horizontal axis and press substances collected in the collection unit against a side of the collection unit.

The apparatus for treating clothes also may include a driving gear that is configured to move the compression unit along the horizontal axis and rotate the substance removal unit. The driving gear may further include a first driving gear that is configured to move the compression unit along the horizontal axis and a second driving gear that is configured to rotate the substance removal unit.

The apparatus for treating clothes also may include a Hall Effect sensor positioned in the collection unit, a first magnet coupled to the compression unit and a second magnet coupled to the substance removal unit. The first magnet is coupled to the compression unit such that movement of the compression unit can be sensed by the Hall Effect sensor. The second magnet is coupled to the substance removal unit such that movement of the substance removal unit can be sensed by the Hall Effect sensor. The movement of the substance removal unit and the movement of the compression unit may occur at different times. The substance removal unit may be placed in a pre-determined position when not in operation, wherein a stopping position of the substance removal unit at the termination of operation of the substance removal unit is detected by the Hall Effect sensor such that the substance removal unit is re-positioned in the pre-determined position if the stopping position of the substance removal unit is different from the pre-determined position.

The compression unit may include a compression plate configured to move within the collection unit, and a driving motor for moving the compression plate. The bottom of the collection unit of the apparatus for treating clothes may include a mesh such that air is able to flow through the bottom of the collection unit.

The apparatus with the compression unit may include an entrance attached to an enclosure of the apparatus, wherein the compression unit is accessible from the outside the apparatus using the entrance, and the compression unit is removable from the enclosure of the apparatus through the entrance. The compression unit may further include a sensing unit for sensing an amount of substances held in the collection unit. The sensing unit may be configured to compare a reciprocating period of the compression unit to a predetermined reference period for sensing the amount of substances held in the collection unit. The compression unit may further include a compression plate configured to move within the collection unit, a driving motor for moving the compression plate, and a power transmission unit connected between the driving motor and the compression plate. The sensing unit may include a contact sensor configured to sense a reciprocating period of the compression plate when brought into contact with the compression plate.

In another general aspect, an apparatus for treating clothes may include an accommodating space configured to receive one or more clothing articles, an air supply unit configured to supply air to the accommodating space, a duct unit configured to guide discharge of air from the accommodating space, a filter unit positioned to filter substances from air discharged from the accommodating space through the duct unit, a substance removal unit configured to move substances remaining on a portion of the filter unit to a predetermined area of the filter unit, and a compression unit configured to compress substances in the predetermined area of the filter unit.

Particular implementations may include one or more of the following features. For example, the substance removal unit may include a rotating brush. The compression unit may include a plate configured to move in the predetermined area of the filter unit and press substances collected in the predetermined area of the filter unit against a side of the predetermined area of the filter unit.

The apparatus may further include a substance separating unit for separating the substances from the brush. The compression unit may include a collection part for holding the substances, and a nozzle for spraying water in a direction of the substance separating unit. The substance separating unit may include a plurality of projections from a surface of the filtering unit, the plurality of projections being positioned within a rotation region of the brush.

DETAILED DESCRIPTION

Clothes treating apparatus capable of drying clothes are classified into two categories based on air flow methods to supply air at a high temperature (e.g., hot air) to clothes: an exhaust type clothes treating apparatus and a circulation type (e.g., condensation type) clothes treating apparatus.

In the circulation type clothes treatment apparatus, air in an accommodating space having clothes received therein is circulated and moisture is removed (e.g., dehumidified) from air exhausted from the accommodating space and the dehumidified air is then heated. The heated air is re-supplied to the accommodating space.

In the exhaust type clothes treatment apparatus, heated air is supplied to the accommodating space and the air discharged from the accommodating space is discharged to the outside of the clothes treating apparatus without being recirculated.

It may be desirable to remove foreign substances such as lint from the air exhausted from the accommodating space provided in a conventional clothes treatment apparatus having a drying function. In case of the circulation type clothes treating apparatus, after dehumidifying the air exhausted from the accommodating space, the circulation type clothes treatment apparatus heats the air by using a heat exchanging device and it re-supplies the heated air to the accommodating space. If foreign substances are not removed before the air is heated, the foreign substances may accumulate in the heat exchanging device. Therefore, the heat exchange efficiency of the clothes treatment apparatus may be lowered.

In case of the exhaust type clothes treating apparatus, if air is discharged from the accommodating space without being filtered, lint or dust contained in the discharged air may be supplied to an indoor space provided with the clothes treating apparatus.

Therefore, it may be desirable to filter air discharged from an accommodating space of a clothes treating apparatus capable of drying clothes. A filter is hence provided in a clothes treatment apparatus to filter foreign substances from the air exhausted from the accommodating space. A mechanism may be provided in the clothes treatment apparatus that enables the filter to be cleaned automatically, thereby reducing the requirement for a user to check the state of the filter before or after the clothes treatment apparatus is used.

FIG. 1 illustrates an example clothes treating apparatus. The configuration of the clothes treating apparatus will be described with reference to FIG. 1.

Referring to FIG. 1, the clothes treating apparatus 100 includes a cabinet 1 which forms an exterior thereof, and an accommodating space 2 in the cabinet for holding the clothes. In case the clothes treating apparatus is used only for drying, the accommodating space 2 can be a drum 21 for holding drying objects and the drum can be cylindrical, with front and rear openings.

On a front side of the drum 21, there can be a front supporting portion 25 provided for supporting an opened front side of the drum, and on a rear side of the drum, there can be a rear supporting portion 27 for supporting an opened rear side of the drum.

The front supporting portion 25 has a laundry opening 251 for introducing clothes to the drum or taking out clothes from the drum, and the laundry opening 251 can be closed by a door 3 rotatably provided to the cabinet.

The door 3 can further include a door glass 31 extended toward the laundry opening 251, not only for enabling a user to observe an inside of the drum during operation of the clothes treating apparatus, but also for guiding the clothes moving toward the door to the inside of the drum during rotation of the drum.

The rear supporting portion 27 has a supply hole 271 for supplying external air to the drum, and is connected to a supply duct 43 to be described in more detail later.

The drum 21, supported by the front supporting portion 25 and the rear supporting portion 27, is rotatable by a drum motor 213 and a belt 215, and can have lifters 211 on an inside circumference thereto for easy agitation of the drying objects, additionally.

The clothes treating apparatus can further include a duct 4 and an air supply unit 5 for supplying air (e.g., hot air) to the clothes in the drum. The duct can have a discharge duct 41 for discharging the air from the drum 21, and a supply duct 43 for supplying the air into the drum 21.

The discharge duct 41 has a suction hole 411 for introduction of the air thereto from drum 21, and the supply duct 43 is in communication with the discharge duct, and connected to a supply hole at the rear supporting portion for supplying the air to the drum through the air supply unit 5.

In case of the air circulating type clothes treating apparatus, the discharge duct 41 and the supply duct 43 are connected to each other to form a flow passage, and the air supply unit 5 may include a fan 55 for causing an air flow, a condensing part for dehumidifying the air flowing in the duct 4, and a heating part for heating the air dehumidified thus.

The fan 55 may be an air circulating unit for introducing the air from the drum to the discharge duct 41, provided to be rotatable by the drum motor 213.

If the fan 55 rotates, the air is introduced to an inside of the drum 21 from an inside of the duct 4. If the air is introduced to the inside of the drum 21 from the inside of the duct, the air inside of the drum will be introduced to an inside of the discharge duct 41 through the suction hole 411. Since the air introduced to the discharge duct flows toward the supply duct 43 through the air supply unit 5 while being dehumidified and heated, the clothes in the drum 21 can be dried.

The circulating type clothes treating apparatus may have foreign substances, like lint, that are formed therein during clothes drying. The foreign substances from the clothes circulate along the duct 4. Therefore, if the foreign substances are not filtered from the air being discharged from the drum, the foreign substances may stick to a surface of a heat exchanger, such as the condensing part, or the heating part, resulting in poor drying efficiency of the clothes treating apparatus.

In order to address such an issue, the clothes treating apparatus of the present disclosure further includes a filter assembly 6 for filtering the foreign substances from the air circulating along the duct 4, not only to reduce a reduction in the drying efficiency, but also to reduce a flow rate from decreasing due to the foreign substances filtered.

Moreover, the clothes treating apparatus of the present disclosure further includes a foreign substance compression unit 7 for compressing and holding the foreign substances filtered by the filter assembly thus.

The filter assembly 6 can be detachably provided to the suction hole 411 in the discharge duct. In this case, the user can detach the filter assembly from or attach the filter assembly 6 to the clothes treating apparatus after opening the door 3.

The foreign substance compression unit 7 can be provided to be taken out from the filter assembly 6 through an entrance 15 in a front of the cabinet 1 by the user. In this case the foreign substance compression unit 7 may be provided to an outside of the discharge duct 41 in communication with a bottom of the filter assembly 6.

Figure 2:
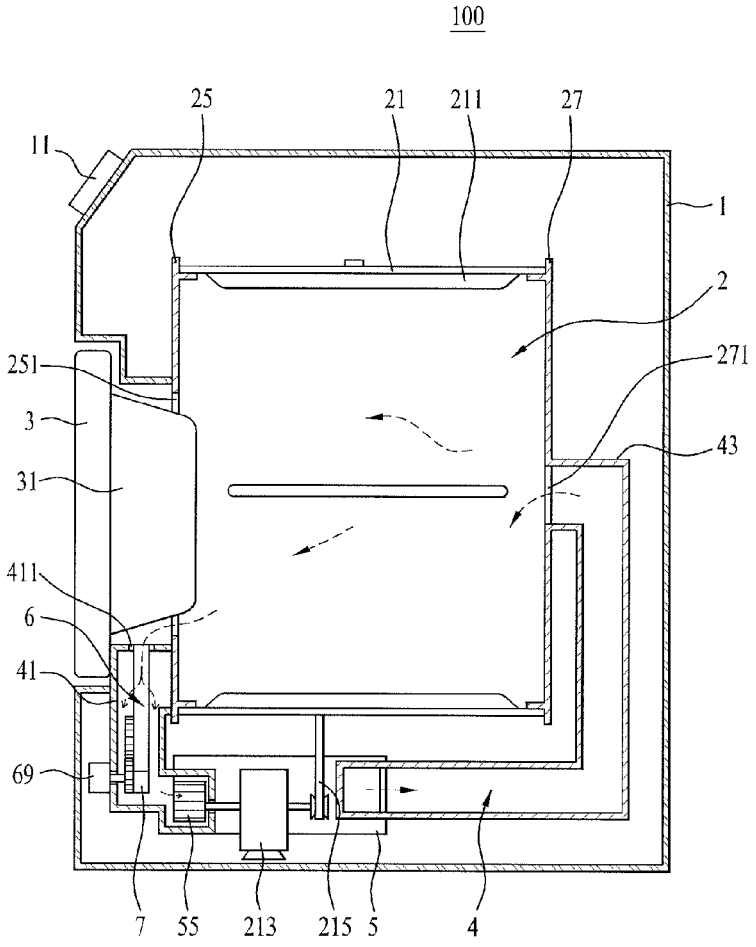
FIG. 2 illustrates an example clothes treating apparatus in accordance with another aspect of the present disclosure.

Different from FIG. 1, as shown in FIG. 2, the foreign substance compression unit 7 can be detachably provided to the bottom of the filter assembly 6 on an inside of the discharge duct 41.

In this case, the user can clean the foreign substance compression unit 7 after opening the door 3, taking the filter assembly 6 out of the discharge duct 41, and separating the foreign substance compression unit 7 from the filter assembly.

Though the filter assembly and the foreign substance compression unit have been described with reference to a case in which the filter assembly and the foreign substance compression unit are provided to the circulating type clothes treating apparatus, the filter assembly and the foreign substance compression unit can also be applied to a clothes treating apparatus which can wash and dry clothes, or the exhaust type clothes treating apparatus of which only performs drying of the clothes.

Figure 22:
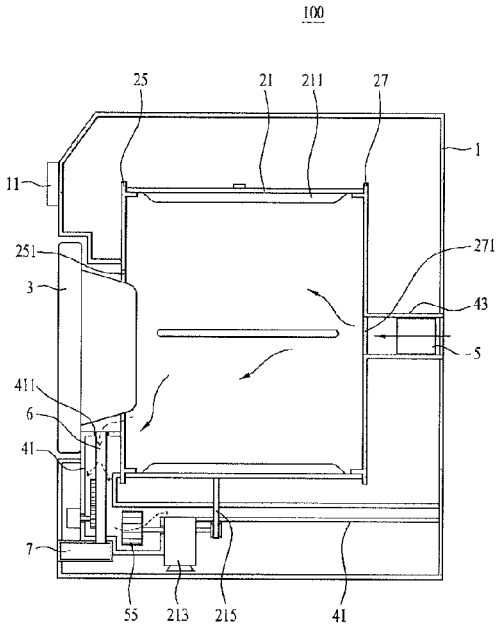
FIGS. 22 and 23 illustrate an example treating apparatus with a filter assembly and a foreign substances compression unit.

That is, the filter assembly 6 and the foreign substance compression unit 7 can also be applied to the exhaust type clothes treating apparatus (e.g., in a case the object of the clothes treating apparatus is only drying of the clothes) shown in FIG. 22.

The exhaust type clothes treating apparatus has a structure in which external air is heated with the air supply unit 5, and hot air is supplied to the inside of the accommodating space 21 (e.g., drum), while the air in the accommodating space 21 is discharged to an outside of the clothes treating apparatus.

Therefore, in case of the exhaust type clothes treating apparatus, the discharge duct is provided separate from the supply duct 43.

In this case, the filter assembly 6 is detachably mounted to the suction hole 411 in the discharge duct 41 and the heating part and the condensing part of the air supply unit 5 are provided to the supply duct 43. Though FIG. 22 illustrates a case in which the supply duct 43 is provided to be in communication with an outside of the cabinet, the supply duct 43 may be provided to supply the air from the inside of the cabinet to the inside of the accommodating space.

Figure 23:
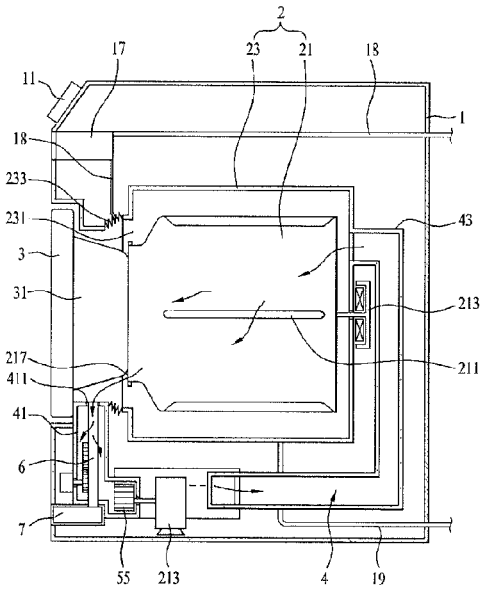

FIG. 23 illustrates an example treating apparatus with a filter assembly and a foreign substances compression unit. FIG. 23 illustrates a longitudinal section showing a structure of the circulating type clothes treating apparatus which can wash and dry. Referring to FIG. 23, the circulating type clothes treating apparatus may include a tub 23 for storing the washing water and a drum 21 rotatably provided in the tub 23. Therefore, in the clothes treating apparatus which can wash and dry, the accommodating space 2 has a concept including both the tub 23 and the drum 21.

In order to make introduction/taking out of the clothes into/from the accommodating space, the tub has a tub opening 231 provided therein, and the drum has a drum opening 217 in communication with the tub opening.

Moreover, the structure has a supply hose 18 for supplying the washing water, a drain hose 19 for draining the washing water from the tub additionally, and the supply hose 18 can be provided to be in commutation with the tub via a detergent box 17.

And the tub and the cabinet may be sealed by a gasket 233, the discharge duct 41 is in communication with a front of the tub 23, and the supply duct 43 is in communication with a rear of the tub.

However, different from FIG. 23, the supply duct may be positioned to supply the air through a front of the tub. The filter assembly 6 is detachably provided to the suction hole 411 in the discharge duct.

Referring to FIG. 1, the drum motor 213 which rotates the drum 21 can be provided to rotate the fan 55 and the drum 21 at a same time, or as shown in FIG. 23, only to rotate the drum.

In the former case, a drive pulley can be provided to the drum motor, and a driven pulley can be provided to a rear of the tub connected to the drive pulley with a belt. However, the driven pulley may be provided fixed to a rotation shaft which is connected to the rear of the drum.

Figure 3:
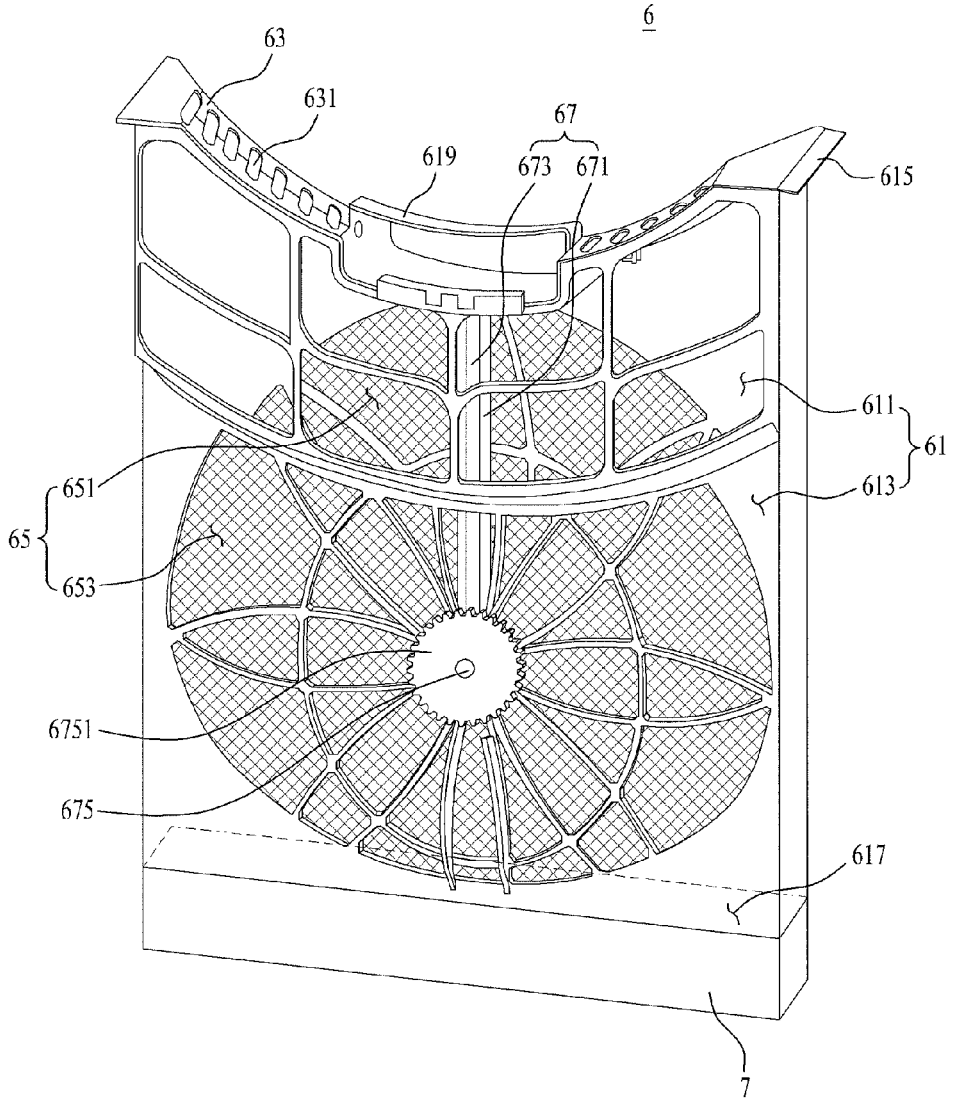
FIG. 3 illustrates an example filter assembly.

A structure of the filter assembly 6 will be described with reference to FIG. 3. The filter assembly 6 can include a housing 61 detachably provided to the suction hole 411 in the discharge duct, an inflow surface 63 in communication with the suction hole 411 for introduction of the air into the housing, a filtering unit 65 for filtering foreign substances like lint introduced into the housing, and a foreign substances removal unit 67 for transferring (e.g., moving) the foreign substances remained in the filtering unit to the foreign substance compression unit 7.

The housing 61 includes a first housing 611 and a second housing 613 detachable from each other, and the inflow surface 63 can be provided to a top side of the first housing or the second housing. FIG. 3 illustrates the inflow surface 63 provided to a top side of the first housing 611. The housing has a discharge part 617 at one side in communication with the foreign substance compression unit 7.

The inflow surface 63 may have a shape in conformity with a shape of the suction hole 411 in the discharge duct, and the inflow surface 63 has a plurality of inflow holes 631 for guiding the air from the suction hole 411 to an inside of the housing 61.

Moreover, the housing 61 can further include a housing fastening part 615 provided for attachment/detachment of the housing 61 to the discharge duct, and a handle 619 for easy attachment/detachment of the housing to/from the discharge duct.

The filtering unit 65 can be provided to at least one side of the housing 61 for removing the foreign substances from the air discharged from the accommodating space and supplying the air to the duct 4.

That is, the filtering unit 65 can have a shape of mesh which can remove the foreign substances from the air being introduced to the housing and allow the air having the foreign substances removed therefrom to flow along the discharge duct 41.

The filter assembly 6 of the present disclosure can include one pair of filters provided on opposite sides of the inflow surface 63 for increasing a filtering capacity (e.g., increasing a flow rate of the air passing through the filter assembly).

That is, the filtering unit can include a first filter 651 provided to the first housing 611, and a second filter 653 provided to the second housing 613.

The foreign substances removal unit 67 is rotatably provided in the housing 61 for moving the foreign substances remained in the filtering unit 65 to the foreign substance compression unit 7.

For this, the foreign substances removal unit can include a brush 671 provided to be brought into contact with the filtering unit 65, a brush frame 673 fixed to the brush, and a brush rotation shaft 675 for transmitting power from a brush motor 69 (see FIGS. 1 and 2) to the brush frame.

The brush rotation shaft 675 is placed in a brush frame passed through the filtering unit 65, and the brush rotation shaft may have a brush driven gear 6751 positioned on an outside of the housing 61.

The brush driven gear 6751 rotates when a brush driving gear 693 (see FIG. 1) provided to the brush motor 69 is rotated. The brush motor 69 may be positioned on an outside of the discharge duct 41, and the brush driving gear 693 is positioned in the discharge duct and coupled to the rotation shaft 691 (see FIG. 1) of the brush motor.

Accordingly, if the user attaches/detaches the filter assembly 6 to/from the suction hole 411 in the discharge duct, the brush driving gear can be engaged with the brush driven gear.

Figure 4:
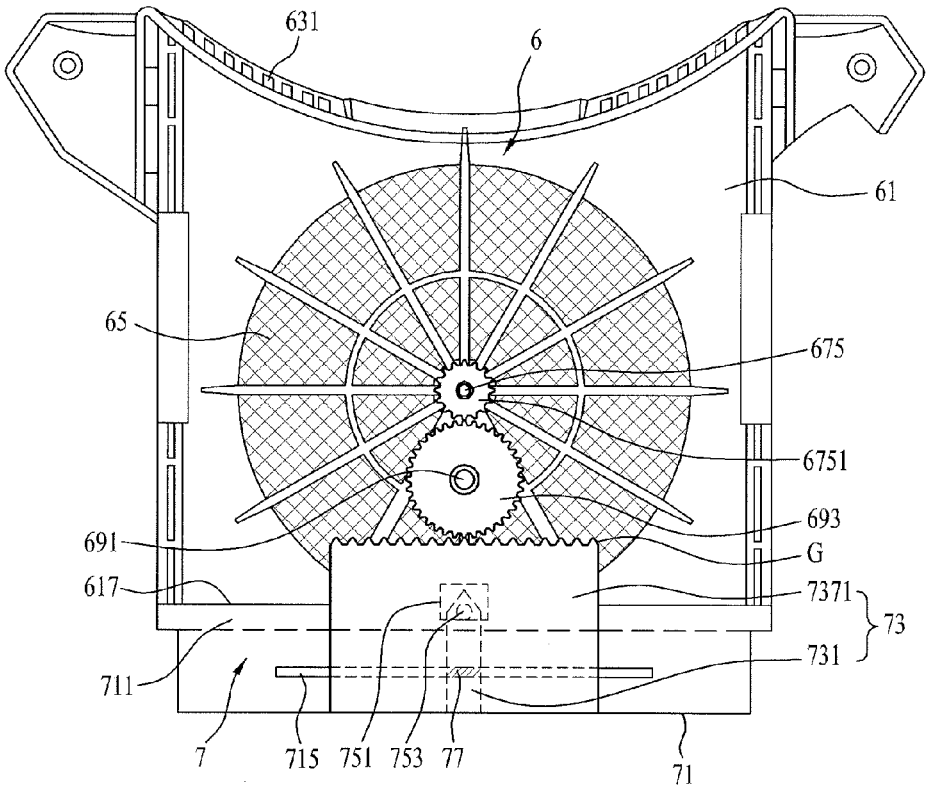
FIGS. 4, 5, and 6 illustrate a foreign substance compression unit in a filter assembly.

Though FIGS. 1 and 4 illustrate a power transmission structure only including a brush driving gear and a brush driven gear respectively, there may be a connection gear for connecting the brush driving gear to the brush driven gear.

The connection gear may transmit the rotation power to the foreign substances removal unit in case the brush motor is positioned such that direct coupling of the brush driving gear to the brush driven gear is difficult.

Though FIGS. 1 and 4 illustrate cases in which the brush driving gear and the brush driven gear are provided on a straight line, the brush driving gear and the brush driven gear can be provided spaced by a predetermined angle from each other in the inserting direction of the filter assembly.

That is, the rotation shaft 691 of the brush motor and the brush rotation shaft 675 may not be on a straight line.

The filter assembly 6 is placed in the discharge duct 41 through the suction hole 411. In this instance, if the brush driven gear 6751 and the brush driving gear 693 are positioned on the straight line, a problem may arise due to failure in the exact engagement of teeth of the brush driving gear 693 and the brush driven gear 6751.

Although the teeth of the brush driving gear and the teeth of the driven gear are not correctly engaged with each other, when the filter assembly is inserted into the discharge duct, the teeth of the brush driving gear and the teeth of the brush driven gear may be damaged. The above structure using a connection gear can address the problem.

A structure of the foreign substance compression unit which compresses the foreign substances exhausted from the filter assembly will be described. At first, the structure of the foreign substance compression unit shown in FIG. 4 will be described.

The foreign substance compression unit 7 includes a collection part 71 for holding the foreign substances discharged to the discharge part 617 of the housing by the foreign substances removal unit 67, and a compression part 73 for moving the foreign substances introduced to the collection part to one side for compressing the foreign substances.

The collection part 71 has an opened side 711 in communication with the discharge part 617 of the housing, and the compression part 73 has a compression plate 731 for moving within the collection part 71.

The compression plate 731 is coupled to a rack body 7371 having a rack (G) engaged with the brush driving gear 693. The rack body 7371 is provided to an outside of the collection part 71.

Since the compression plate 731 is positioned in the collection part 71, and the rack body 7371 is positioned on the outside of the collection part 71, the compression plate is fixed to the rack body with a coupling piece 77, and the collection part may have a cut-away portion 715 provided along a length direction thereof and passed through the coupling piece 77.

That is, the foreign substance compression unit 7 of the implementation reciprocates the compression plate 731 with a pinion-gear system, which may provide an advantage in that no additional driving motor is required for reciprocating the compression plate 731 within the collection part 71.

If the brush 671 discharges the foreign substances to the collection part 71 while rotating in clockwise and counterclockwise directions, the foreign substance compression unit 7 having the above structure enables the compression plate 731 to reciprocate in left/right directions (when seen from above the drawing) to compress the foreign substances introduced to the collection part.

Lengths of the rack body 7371 and the cut-away portion 715 can vary with a reciprocating length of the compression plate.

FIGS. 5A and 5B illustrate an example of a foreign substance compression unit 7 in accordance with another implementation of the present disclosure, including the collection part 71 and the compression part 73. However, the implementation may provide a driving motor separately for driving the compression part 73.

Figure 5:
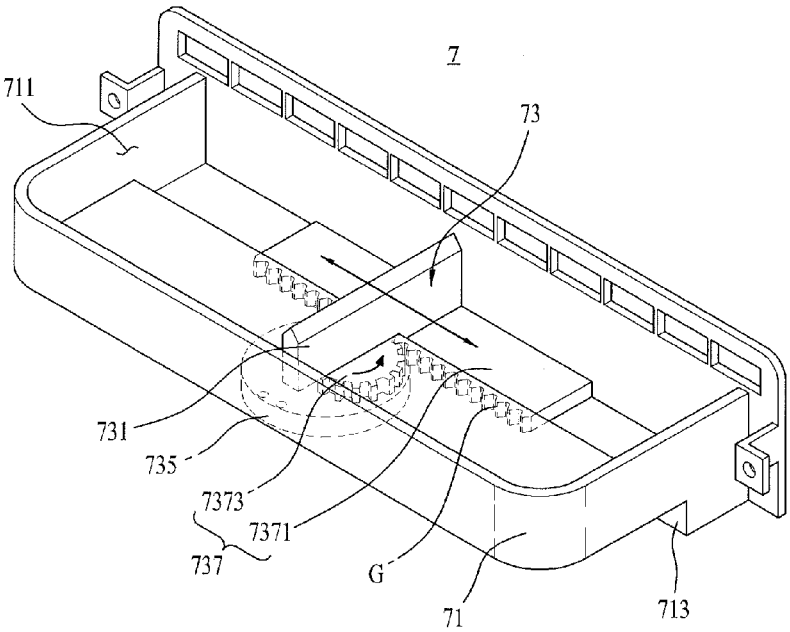
Figure 5:
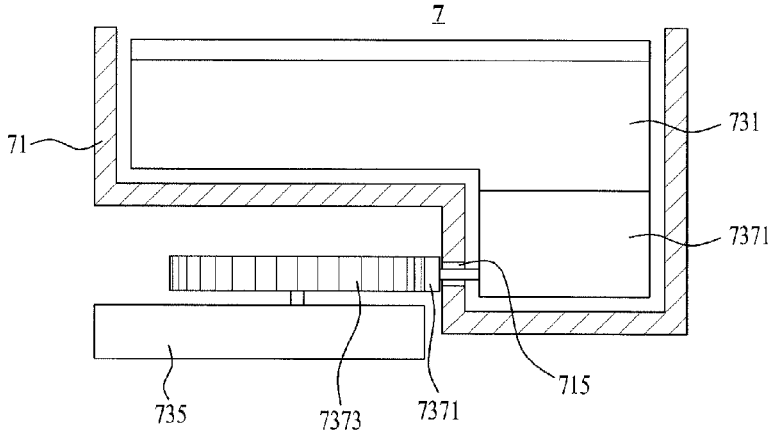

The collection part 71 is in communication with the discharge part 617 of the filter assembly through the opened side 711 for providing a space for collecting the foreign substances, such as lint. That is, as shown in FIG. 5, the collection part 71 has a hexahedral shape having an opened top side.

The collection part 71 has a moving path 713 on a bottom for guiding movement of the compression plate 731.

The compression part 73 includes the compression plate 731 for moving the foreign substances to one side of the collection part, a driving motor 735 provided on an outside of the collection part, and power transmission mechanism 737 for changing rotation power from the driving motor to reciprocating movement of the compression plate 731.

The power transmission mechanism 737 includes a pinion gear 7373 provided to a rotation shaft of the driving motor, and a rack body 7371 having a rack G engaged with the pinion gear.

In this case, the rack body 7371 may be positioned in the moving path for the rack body 7371 to reciprocate in a manner guided by the moving path 713, and the compression plate 731 is fixed to the rack body 7371.

That is, the pinion gear 7373 is a drive gear connected to the drive motor, and the rack G of the rack body 7371 is a driven gear engaged with the pinion gear.

Accordingly, the clockwise and counterclockwise rotation of the drive motor reciprocates the compression plate 731, and during the reciprocating motion, the foreign substances held in the collection part are compressed to opposite sides of the compression part.

However, the moving path 713 may have a cut-away portion 715 in a front side of the moving path 713 for the teeth of the rack 7371 and the pinion gear to engage with each other. The compression plate 731 may be a plate with a top side sloped on opposite sides for the foreign substances flowing down in left/right directions of the compression plate.

Moreover, the compression plate may have a length in conformity with an inside width of the collection part 71.

The rack body 7371 may have a length below ½ of the length of the collection part 71, or the same with the length of the collection part 71.

If the length of the rack body is half of the length of the collection part 71, a reciprocating length of the rack body 7371 will be the greatest.

In this case, the compression plate 731 can be positioned at a middle of the rack body 7371 as shown in FIG. 6A, or at one side of the rack body 7371 as shown in FIG. 6B.

In the case in which the compression plate is provided on one side of the rack body, the compression plate 731 can be provided to be brought into contact with an inside wall of the collection part 71, and the top side of the compression plate can be provided to be sloped toward the inside of the collection part 71.

If the length of the rack body is the same or greater than the length of the collection part, rack body holes 719 (see, for example, FIG. 7) may be provided in the collection part 71 for leading a portion of the rack body beyond the collection part.

If the length of the rack body is greater than the length of the collection part, it may be advantageous in that the compression plate 731 can reciprocate from one end to the other end of the collection part for compressing the foreign substances held in the collection part 71.

Though the compression part 73 employs the rack and the pinion gear as a power transmission mechanism, other power transmission mechanisms may be used and the disclosure is not limited to a structure of the rack and the pinion gear.

That is, the power transmission mechanism can be changed to a variety of modes which can convert the rotational movement of the drive motor into the reciprocating movement of the compression plate.

For example, the power transmission mechanism can be a hinge and a crank, or a worm and a gear. Moreover, the drive motor and the power transmission mechanism can be a permanent magnet provided to the compression plate and an electric magnet provided at a position adjacent to the compression plate.

A structure of the foreign substance compression unit 7 having a sensing part for sensing an amount of the foreign substances held in the collection part will be described.

Figure 7:
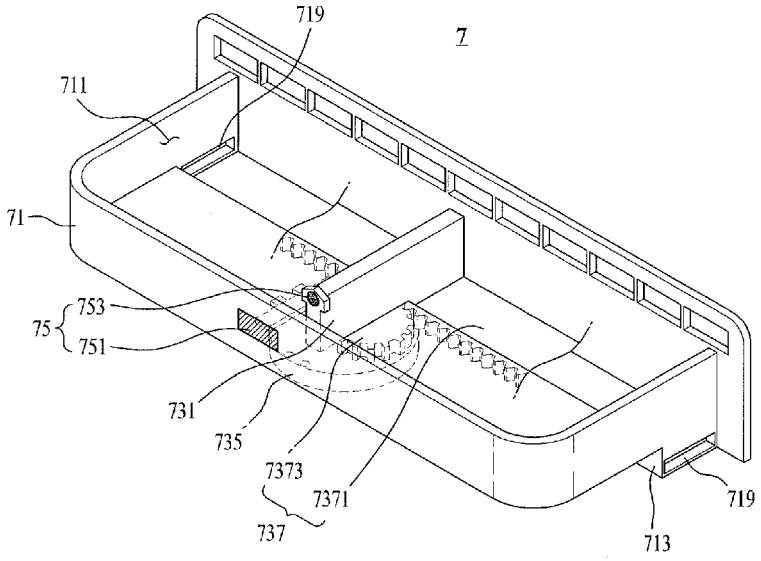
FIGS. 7 and 8 illustrate a foreign substance compression unit including a sensing part.

Since a basic structure of the foreign substance compression unit in FIG. 7 is similar to foreign substance compression units described before, the description of the foreign substance compression unit in FIG. 7 focuses on a configuration and features of the sensing part 75. The sensing part 75 senses an amount of the lint collected in the collection part 71 by measuring a reciprocating period of the compression plate 731.

The sensing part 75 can include a period measuring unit for measuring a reciprocating period of the compression plate 731, and a control unit for comparing the reciprocating period to a preset reference period to calculate the amount of the lint.

The period measuring unit can include a sensor 751 (e.g., a hall effect sensor) and a magnet 753 provided to the collection part and the compression plate respectively, and the control unit compares a reciprocating period of the compression plate obtained as the control unit measures a number of times of the magnet passes through the sensor within a fixed time period to a reference period.

As the magnet comes closer to the sensor 751, the sensor outputs a higher voltage, and the sensor 751 transmits a voltage proportional to flux measured from the magnet 753 to the control unit.

Therefore, if a position of the compression plate 731 at the time the foreign substance compression unit 7 is not in operation is defined as a parking location (e.g., the parking location in FIG. 7A is middle of the moving path 713, and the parking location in FIG. 7B is a sidewall of the collection part 71), and if the compression plate 731 is at the parking location, the sensor 751 transmits a maximum voltage value to the control unit.

If the voltage value is M when the compression plate is at the parking location, the Hall Effect sensor 751 transmits the voltage value M to the control unit whenever the compression plate 731 passes the sensor, and the control unit can calculate the reciprocating period of the compression plate 731 by using the number of times the voltage value M is transmitted from the sensor 751 within a fixed time period.

Since the reciprocating period of the compression plate 731 varies with the amount of the foreign substances in the accommodating space, if the control unit has the reference reciprocating period of the compression plate on the amount of the foreign substances stored therein, the control unit can determine the amount of the foreign substances from the reciprocating period measured.

Though positions of the sensor 751 and the magnet 753 can vary, since it is required to connect a power line to the sensor 751, the sensor may be provided to the collection part 71, and the magnet may be provided to the compression plate 731.

Moreover, the control unit can be provided to request cleaning of the collection part 71 to the user with a display unit 11 (see FIGS. 1, 2, 22, and 23) or an alarm unit provided to a front of the cabinet if cleaning of the collection part is required.

And, the control unit can also control the drive motor by using above features of the sensing part such that the compression plate is positioned at the parking location when the operation of the foreign substance compression unit 7 is finished.

Figure 8:
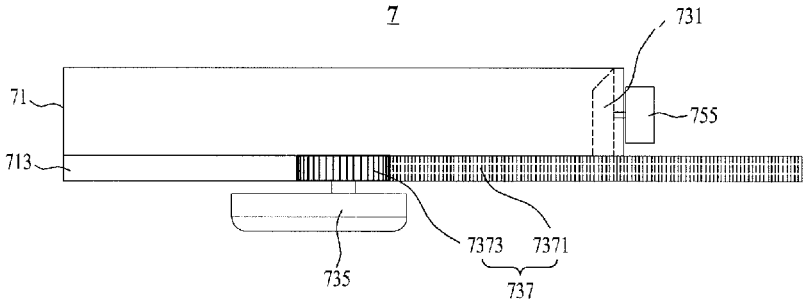

Referring to FIG. 8, the period measuring unit may be a contact sensor 755 provided to a position which can be brought into contact with the compression plate 731 or the rack 7371.

In this case, the contact sensor 755 transmits a signal to the control unit whenever the contact sensor 755 is brought into contact with the compression plate or the rack, and the control unit can calculate a moving period of the compression plate 731 by using a number of transmission times of the signals from the contact sensor 755 within the fixed time period.

Figure 9:
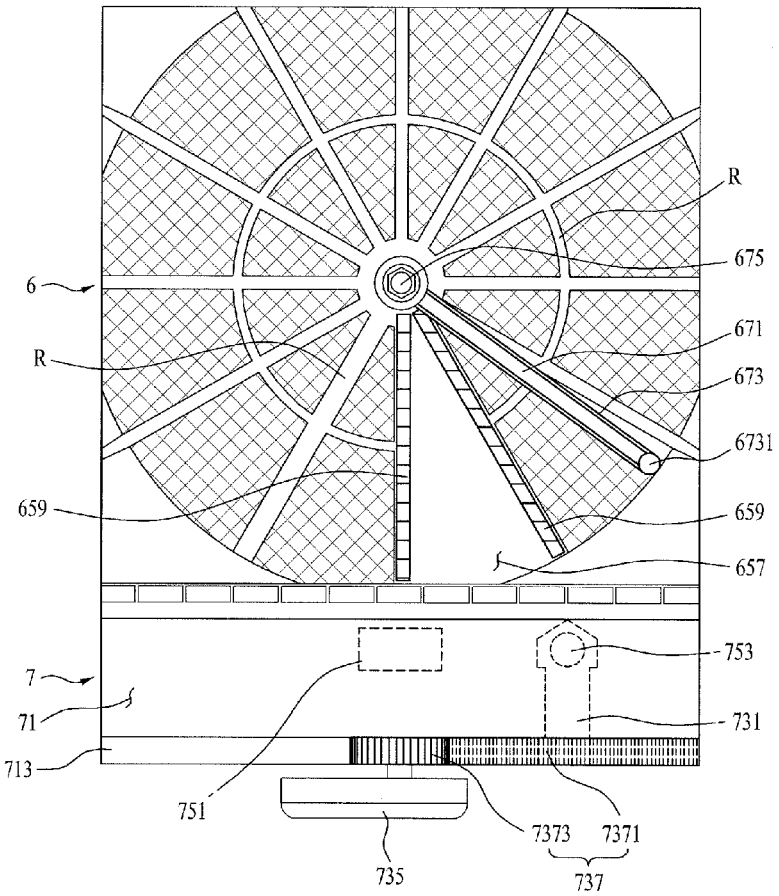
FIG. 9 illustrates an example foreign substance compression unit that can sense a position of a brush and a position of a compression plate.

FIG. 9 illustrates an example foreign substance compression unit that can sense a position of a brush and a position of a compression plate. The sensing part 75 can sense, not only the amount of the foreign substances in the collection part, but also a position of the brush 671 of the foreign substances removal unit 67.

The foreign substances removal unit 67 of the filter assembly of the implementation further includes a brush magnet 6731 provided to the brush frame 673, and the sensor 751 provided to a position at which the sensor 751 can sense the magnet 753 and the brush magnet 6731.

Therefore, as long as the brush frame and the compression plate do not move at a same time, the sensing part 75 can determine positions both of the brush frame 673 and the compression plate 731 by using a single sensor.

As described before, the sensor 751 can output a voltage value proportional to a distance to the magnet. Therefore, by storing a reference voltage value data on a position between the brush frame and the sensor in the control unit, the sensing part can also determine a position of the brush frame.

To determine the position of the brush frame 673 is to reduce reduction of a flow rate of the air passing through the filtering unit caused by the brush frame at the time the removal of the foreign substances by the brush frame is not in progress even though filtering of the foreign substances by the filtering unit is in progress.

That is, though the brush frame can rotate continuously during operation of the clothes treating apparatus, the brush frame can be controlled such that the brush frame is rotated only when it is determined that a predetermined amount of the foreign substances is filtered and stuck to the filtering unit.

In this case, it may not be desirable that the brush frame is left at a random position of the filtering unit 65, reducing the flow rate of the air passing through the filtering unit.

Accordingly, if the brush magnet 6731 and the sensor 751 are provided to the filter assembly and the foreign substance compression unit respectively, the above issue can be addressed.

For this, the filtering unit 65 may further include a frame housing part 657 at a position such that the reduction of the flow rate caused by the brush frame can be reduced, and the control unit is provided to position the brush frame 673 at the frame housing part 657 when rotation of the brush frame is not required.

The frame housing part 657 can be provided to a rib R provided to the housing 61 for supporting the filtering unit 65, or as shown in FIG. 9, the frame housing part 657 can be provided between one pair of foreign substances separating units 659 projected from the filtering unit for separating the foreign substances from the brush 671.

In a latter case, since the foreign substances separating units 659 separate the foreign substances from the brush 671 during movement of the brush frame 673 to the frame housing part 657, the foreign substances removed by the brush can be moved to the collection part 71.

A method for controlling a clothes treating apparatus having the filter assembly and the foreign substance compression unit shown in FIG. 9 applied thereto will be described.

If the brush motor 69 and the drive motor 735 of the compression unit are not in operation at the same time, the method for controlling a clothes treating apparatus includes a foreign substances removal step, a brush parking step, a foreign substances compression step, and a compression plate parking step.

The foreign substances removal step is a step in which the brush frame 671 is rotated by the brush motor 69 (see, for example, FIG. 1) for the brush to remove the foreign substances from the filtering unit 65.

In the foreign substances removal step, the compression plate of the compression unit 7 does not reciprocate.

The brush parking step is a step in which the brush frame is moved to the brush housing portion 657 by using the sensing part 75.

The brush parking step progresses as the sensor 751 senses a magnetic field of the brush magnet 6731 provided to the brush frame and transmits a voltage value matched thereto to the control unit, and the control unit rotates the brush motor 69 until the voltage value transmitted from the sensor is the same with the reference voltage value.

The reference value is a voltage value sensed at the sensor in case the brush frame is housed in the brush housing portion.

Since the brush 671 passes the foreign substances separating units 659 during movement of the brush frame 673 to the frame housing part 657, the foreign substances separated from the brush fall in a direction of the collection part 71.

The foreign substances compression step is a step in which the compression plate 731 compresses the foreign substances in the collection part 71.

That is, in the foreign substances compression step, since the control unit drives the drive motor 735 to reciprocate the rack body 7371 in left/right directions within the collection part, the foreign substances are compressed to, and stored at the opposite ends of the collection part 71.

The compression plate parking step is a step in which the compression plate 731 is moved to a parking location.

That is, the compression plate parking step progresses as the control unit rotates the drive motor 735 until the sensor transmits a voltage value the same with the reference voltage value (e.g., a voltage value the sensor measures at the time the compression plate is at the parking location).

Since an order of the above steps is merely an example, the brush parking step and the compression plate parking step can be progressed after the foreign substances removal step and the foreign substances compression step, or the brush parking step can be performed after the compression plate parking step is performed.

Figure 10:
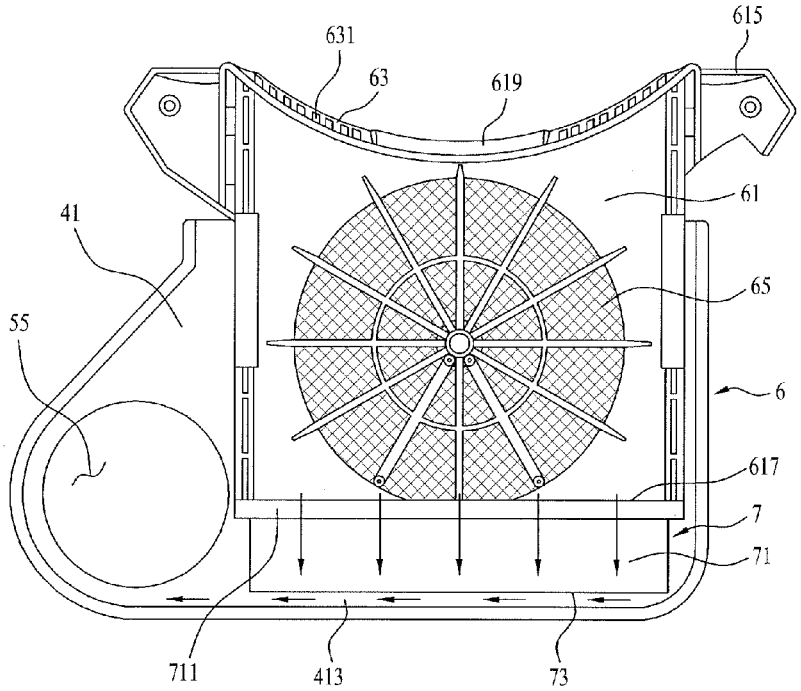
FIG. 10 illustrates an example foreign substance compression unit that compresses foreign substances with air pressure.
Figure 10:
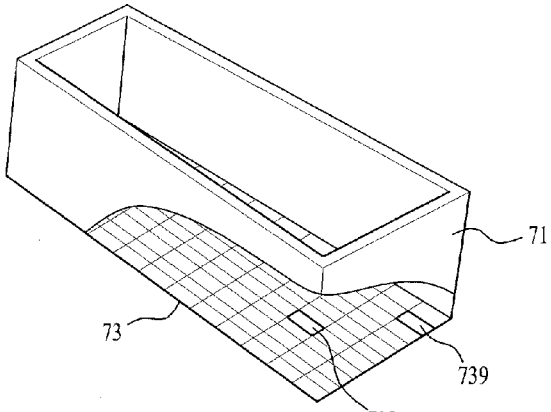

FIG. 10 illustrates an example foreign substance compression unit that compresses foreign substances with air pressure using a fan 55.

The foreign substance compression unit 7 of this implementation includes a collection part 71 for holding the foreign substances, a compression part 73 provided to a bottom surface of the collection part 71 to have a plurality of holes 739 (e.g., as shown in FIG. 10B), and a fan 55 provided to an outside of the collection part 71.

In this case, the discharge duct 41 may further include a flow passage 413 for guiding the air discharged through the holes 739 in the compression part 73 to the fan 55.

At the time of drying the clothes, the fan 55 is rotated. When the fan rotates, the air moves from the accommodating space to the discharge duct 41 and the filter assembly 6, the air is filtered at the filtering unit 65, and the foreign substances filtered at the filtering unit are transferred to the collection part 71 by the foreign substances removal unit in the filter assembly.

A portion of the air introduced to the housing of the filter assembly flows through the holes 739 in the compression part and the flow passage 413, during which course, the foreign substances introduced to the collection part 71 are compressed at the compression part 73 by an air pressure.

Figure 11:
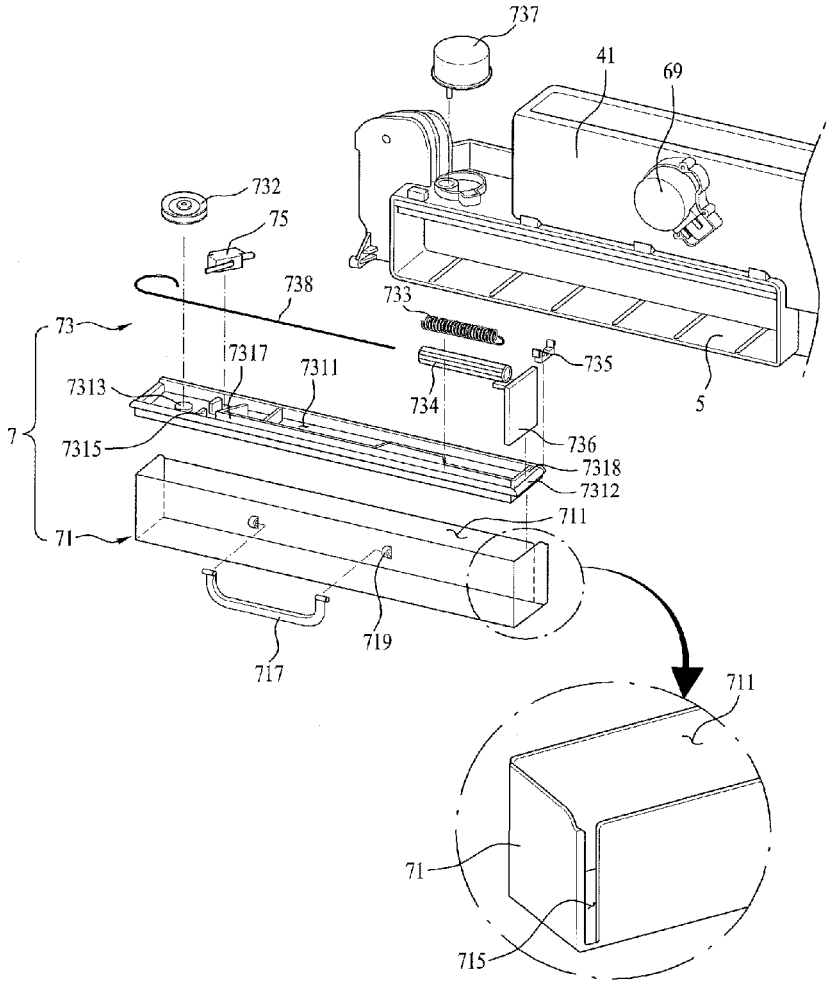
FIGS. 11 and 12 illustrate an example foreign substances compression unit in accordance with another implementation of the present disclosure.

FIG. 11 illustrates an example foreign substance compression unit 7 in accordance with another implementation of the present disclosure. The foreign substance compression unit 7 enables drawing out of the collection part 71 in a front direction of the cabinet 1.

The foreign substance compression unit 7 of the implementation can include a collection part 71 in communication with the filter assembly for holding the foreign substances, a compression part 73 for compressing the foreign substances held in the collection part 71, and a sensing part 75 for determining an amount of the foreign substances held in the collection part 71.

The collection part 71 can be drawn in the front direction of the cabinet through the entrance 15 (see, for example, FIG. 1) in the cabinet, and can include an opened side 711 in communication with the filter assembly, a collection part handle 717, and recesses 719 for securing the collection part handle thereto.

The collection part 71 has a slit 715 in one side for reducing interference of the collection part 71 with a compression plate 736 at the time the collection part 71 is being drawn in the front direction of the cabinet 1 through the entrance 15 (see, for example, FIG. 1).

That is, at the time the compression part 73 is not in operation, the compression plate 736 of the compression part is positioned at one side wall of the collection part 71 (e.g., a right side wall of the collection part in FIG. 11). Therefore, if the user pulls the handle in the front direction of the cabinet, the collection part 71 can be drawn in the front direction of the cabinet without interference with the compression plate 736 through the slit 715.

The compression part 73 includes a guide frame 7312 positioned at the opened side 711 of the collection part 71, the compression plate 736 positioned in the collection part, and a power transmission unit for reciprocating the compression plate within the collection part 71.

The power transmission unit includes a driving motor 737, a converting portion for converting a rotational motion of the driving motor into a linear motion of the compression plate 736, and an elastic portion for returning the compression plate 736 to an initial position.

The converting portion can include a pulley 732 coupled to the rotation shaft of the driving motor, and a wire 738 having one end fixed to the pulley and the other end fixed to the compression plate 736.

The elastic portion is provided for returning the compression plate 736 to an original position after the compression plate 736 is moved to one side of the collection part 71 by the driving motor and so on.

The elastic portion can be a spring 733 having one end fixed to the guide frame 7312 with a spring fastening pin 735, and the other end fastened to the compression plate 736.

However, since the spring is an example of the elastic portion, the elastic portion can vary in materials and structures as far as the materials and structures can carry out the above function.

The compression plate 736 has a spring housing 734 at a top side, to which one end of the spring 733 is fastened. According to this, the spring housing 734 reciprocates together with the reciprocation of the compression plate.

The guide frame 731 has a frame opening 7311 in communication with the opened side 711 of the collection part, and a compression plate placed in slit 7318 for the compression plate to pass through the guide frame.

And, the guide frame 7312 may have a housing guider 7317 for guiding the reciprocation of the spring housing 734, and a connection portion guider 7319 (see, for example, FIG. 12) in the housing guider 7317 for guiding a connection portion of the spring housing and the compression plate 736.

The guide frame can further include a pulley coupling portion 7313 for coupling a pulley 732 thereto and a stopper 7315 for limiting movement of the spring housing 734.

The sensing part 75 includes a contact sensor having a sensing bar 751 (see, for example, FIG. 12), and a control unit for receiving a signal from the contact sensor.

The operation of the foreign substance compression unit 7 will be described.

The foreign substances removal unit 67 discharges the foreign substances to an outside of the filter assembly through the discharge part 617 in the filter assembly, and the foreign substances discharged are introduced to the collection part 71 through the frame opening 7311 in the guide frame.

During operation or finish of the operation of the filter assembly, the control unit puts the driving motor 737 into operation to wind a wire 738 on the pulley 732.

Since the wire 738 is fastened to the spring housing 734, and the spring housing 734 is fastened to the compression plate 736, the compression plate 736 moves in a direction where the driving motor is positioned to compress the foreign substances in the collection part 71.

If the compression plate moves in a direction where the driving motor is positioned, the spring 733 connected to the spring housing 734 and the guide frame 731 extends.

When the compression plate 736 moves to a left side end of the collection part 71, the spring housing 734 is brought into contact with the sensing bar 751, and the control unit stops rotation of the driving motor upon reception of a contact signal from the sensing bar.

Since the compression plate 736 is secured to the guide frame by the spring 733 extended thus, upon stopping of the rotation of the driving motor, the compression plate 736 moves to a right side end of the collection part 71 which is an initial position thereof by restoring force of the spring.

The sensing part 75 can even give notice to the user through the display unit 11 if the collection part 71 is full of the foreign substances upon sensing the amount of the foreign substances held in the collection part 71.

As described before, the sensing part 75 can include the contact sensor (e.g., micro-switch or the like) and the control unit for being transmitted information from the contact sensor.

The contact sensor may be provided at the guide frame 7312 at an end of the moving path of the compression plate 736.

Therefore, if the lint is not full in the collection part 71, the spring housing 734 connected to the compression plate is brought into contact with the sensing bar 751, and if the foreign substances is full in the collection part, the spring housing 734 is not brought into contact with the sensing bar 751.

Figure 12:
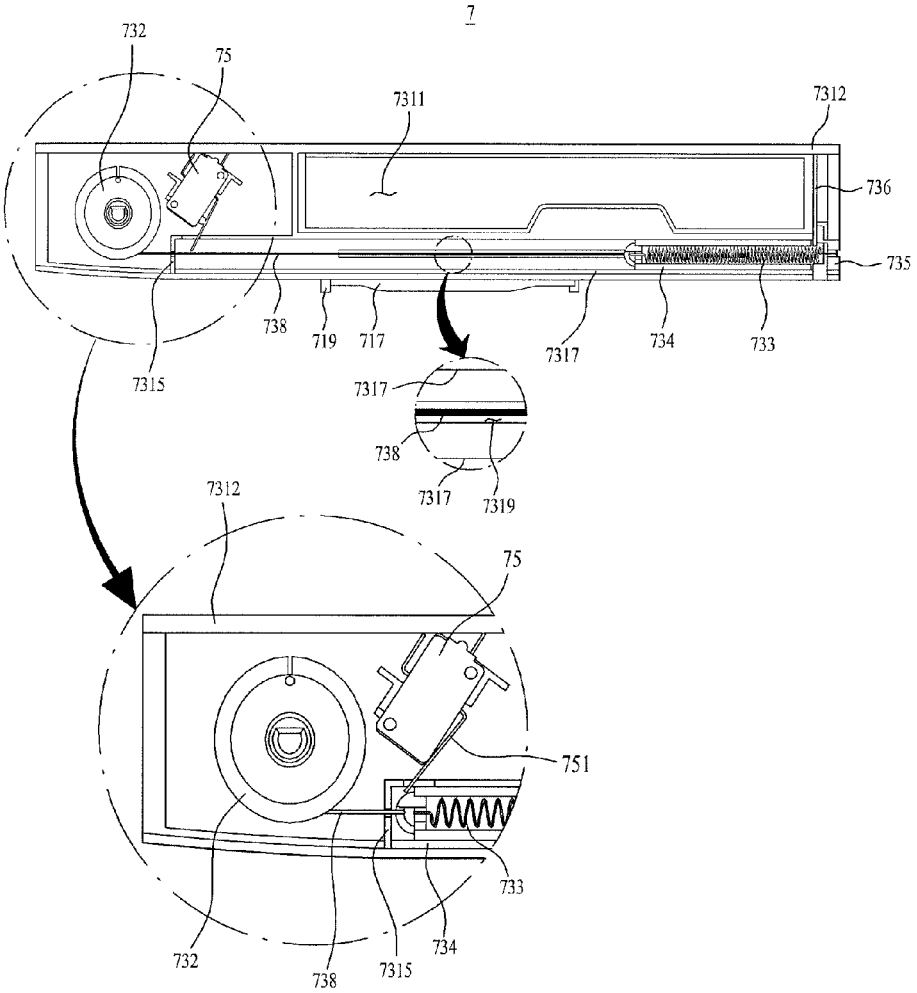

Referring to an enlarged view in FIG. 12, if the collection part 71 is not full of the foreign substances, the spring housing 734 can move to the end of the housing guide 7317 to apply a pressure to the sensing bar 751.

However, if the collection part 71 has a preset amount of the foreign substances held therein, limiting the movement of the compression plate, the spring housing 734 cannot apply the pressure to the sensing bar 751 of the contact sensor.

Accordingly, if the control unit fails to receive a signal from the contact sensor for a time period, even if the driving motor 737 is in operation, the control unit determines that a preset amount of the foreign substances is held in the collection part 71, and gives a notice to the user through the display unit 11.

Figure 13:
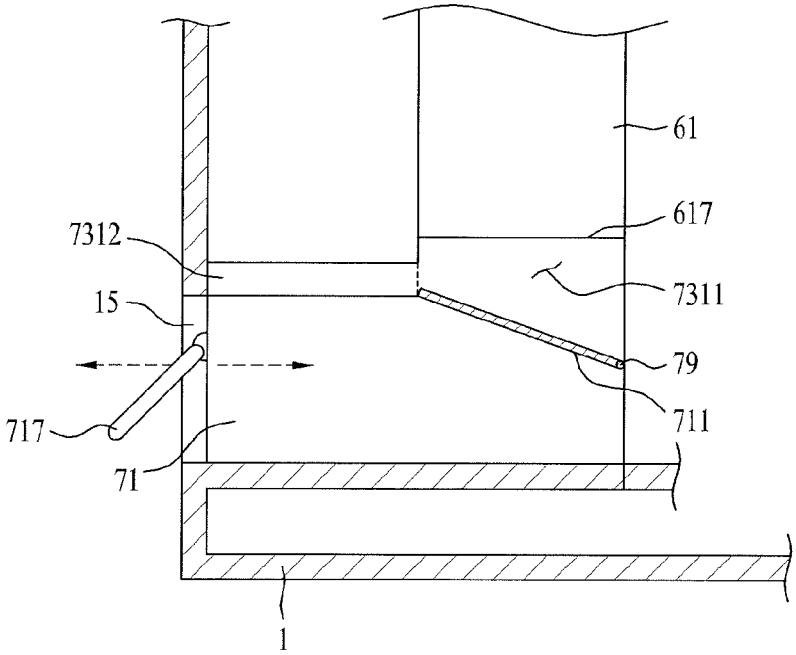
FIG. 13 illustrates a section showing a foreign substance compression unit coupled to a filter assembly.

FIG. 13 illustrates a section showing a foreign substance compression unit coupled to a filter assembly. The opened side 711 of the collection part 71 and the frame opening 7311 of the compression part are coupled together.

In this implementation, the opened side 711 may be provided to be sloped downward in a direction the collection part 71 is placed in, and the frame opening 7311 is provided to have a slope in conformity with the slope of the opened side.

This is, not only for making easy coupling of the opened side 711 to the frame opening 7311 at the time of attachment/detachment of the collection part 71, but also for avoiding the foreign substances discharged from the filter assembly from being discharged to spaces except the collection part 71.

Moreover, at least one of the opened side 711 and the frame opening 7311 can further include a sealing member 79 for sealing a contact surface thereof.

Figure 6:
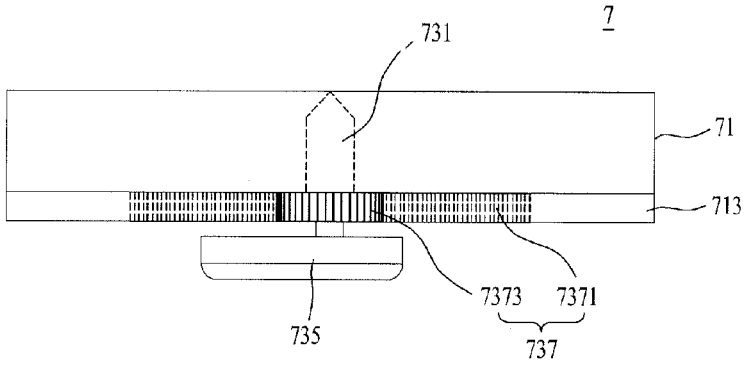
Figure 6:
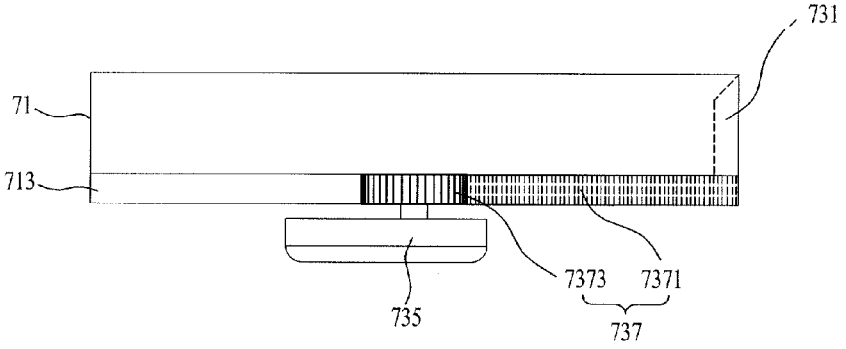

A structure illustrated in FIG. 13 is also applicable to the foreign substance compression unit disclosed in FIGS. 4 to 6.

That is, the foreign substance compression unit disclosed in any one of FIGS. 4 to 6 can be drawn out in a front direction of the cabinet through the entrance 15 (see, for example, FIG. 1) in the cabinet, and the opened side of the collection part and the discharge side of the filter assembly can be provided sloped at angles in conformity with each other.

In this case, the slope angles of the opened side and the discharge side may be provided to make drawing out of the foreign substance compression unit easy, and for example, a height of the collection part positioned at the entrance 15 is made higher than a height of the collection part positioned in the cabinet.

Figure 14:
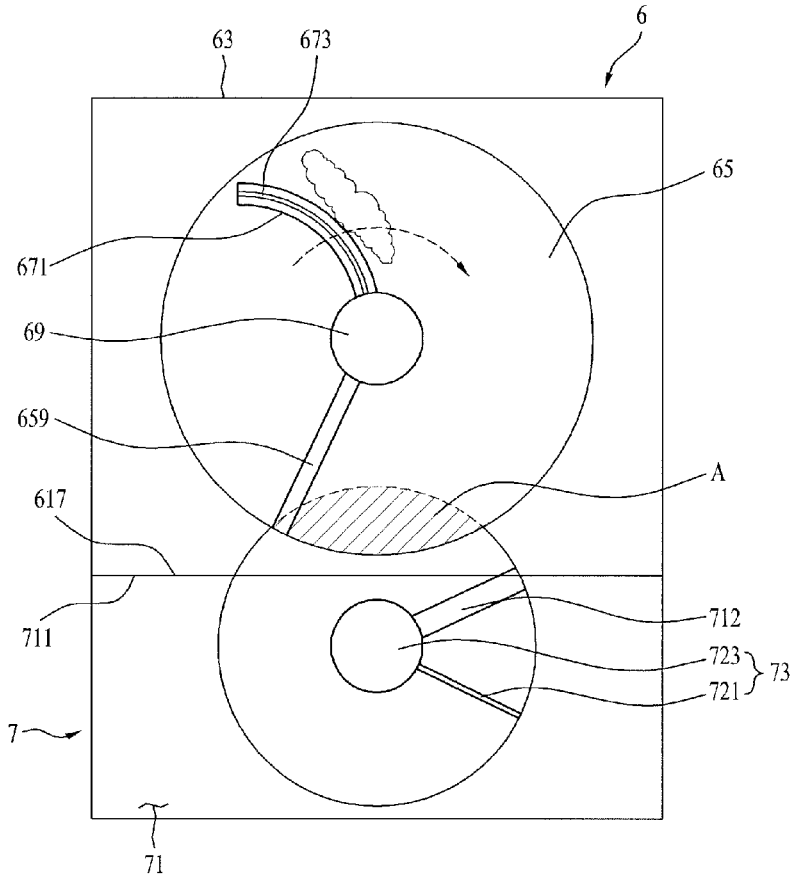
FIGS. 14 and 15 illustrate an example foreign substance compression unit including a rotatable second brush.

FIG. 14 illustrates an example foreign substance compression unit including a rotatable second brush. The rotatable second brush is provided in the collection part 71. In describing this implementation, the brush 671 in the filter assembly 6 will be called as a first brush.

The filter assembly 6 in this implementation can further include a foreign substances separating unit 659 for being brought into contact with the first brush 671 to separate the foreign substances from the first brush 671, wherein the foreign substances separating unit 659 can be projected from the filtering unit 65.

Moreover, the foreign substances separating unit 659 may be provided such that at least a portion of the foreign substances separating unit 659 is positioned in a region (A) where a rotation region of the first brush and a rotation region of a second brush overlap with each other.

The foreign substance compression unit 7 of the implementation includes a collection part 71 for holding the foreign substances from the discharge part 617 of the filter assembly 6, and a compression part 73 for compressing the foreign substances held in the collection part.

The compression part 73 can include the second brush 721 rotatably mounted to the collection part 71, and a driving motor 723 for rotating the second brush.

In this case, the collection part 71 can further include a compression projection 712 for separating the foreign substances being moved by the second brush. The compression projection 712 is projected from an inside surface of the collection part 71 to position within the rotation region of the second brush.

Figure 15:
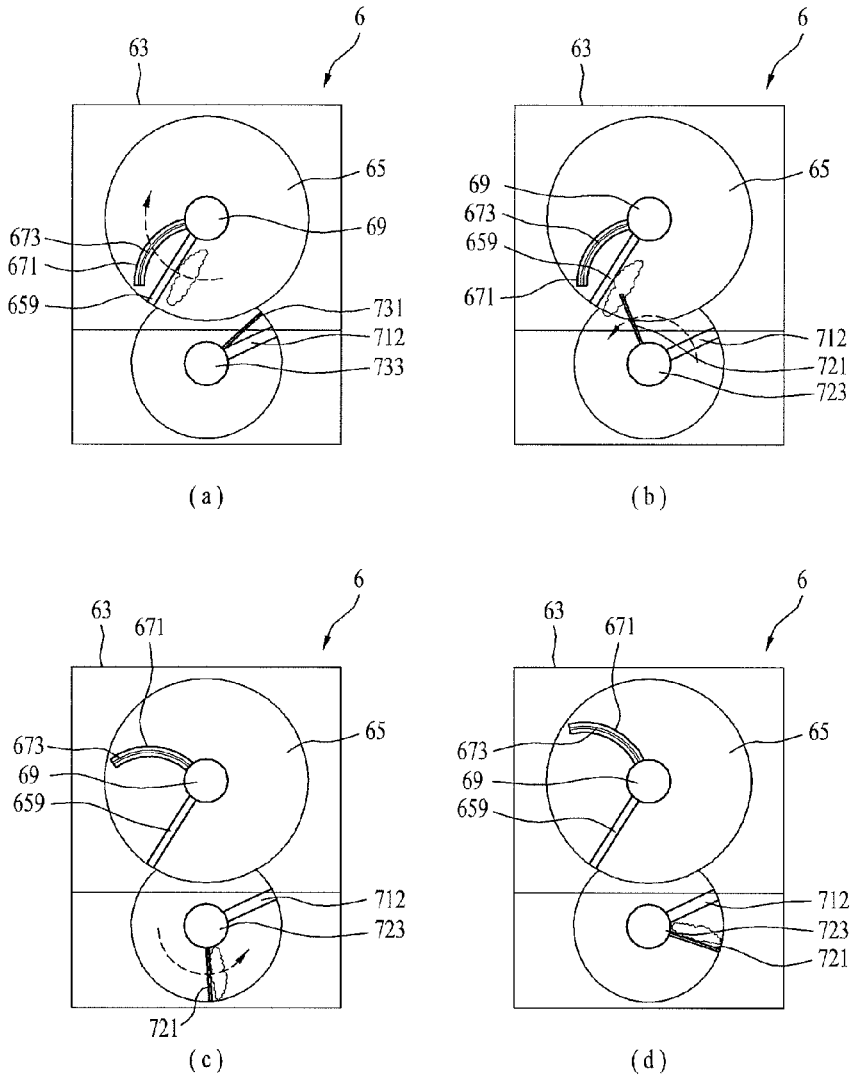

A process of the implementation for compressing the foreign substances will be described with reference to FIG. 15.

Upon putting the clothes treating apparatus into operation, the air is introduced from the accommodating space 2 to the housing 61 through the inflow surface 63 of the filter assembly 6.

Since the air introduced to the housing 61 is supplied to the duct 4 through the filtering unit 65, the foreign substances from the air are remained in the filtering unit 65.

After finishing operation of the clothes treating apparatus, or during operation of the clothes treating apparatus, the control unit controls the brush motor 69 at a preset time for rotating the first brush 671.

Since the first brush 671 rotates in contact with the filtering unit 65, if the first brush rotates, the foreign substances remained in the filtering unit 65 move in a direction of the foreign substances separating unit 659.

If the first brush 671 passes through the foreign substances separating unit 659 (see, for example, FIG. 15A), the foreign substances remain at the foreign substances separating unit.

During operation or finish of the operation of the filter assembly, the control unit controls the driving motor 723 to rotate the second brush 721 provided to the foreign substance compression unit 7.

Since the foreign substances separating unit 659 is provided to an overlapped region A between the rotation region of the first brush and the rotation region of the second brush, if the second brush 731 rotates, the foreign substances remained in the foreign substances separating unit 659 is introduced to the collection part 71 (see, for example, FIGS. 15B-15C).

The foreign substances introduced to the collection part 71 are compressed at the compression projection 712 by rotation of the second brush 721 (see, for example, FIG. 15D) and the foreign substances are separated from the second brush as the second brush 721 passes the compression projection 712.

FIGS. 16, 17, 18, and 19 illustrate an example foreign substance compression unit that compresses foreign substances by using steam or water. The filter assembly of the implementation can further include a foreign substances separating unit 659 for being brought into contact with the brush 671 and separating the foreign substances. The foreign substances separating unit 659 can be provided projected from the filtering unit 65.

That is, referring to FIG. 16B, the foreign substances separating unit 659 can be provided as a plurality of projections from a surface of the filtering unit 65.

The foreign substance compression unit 7 can include a collection part 71 in communication with a discharge part 617 of the filter assembly, and a compression part 73 for spraying water to the foreign substances separating unit 659 to compress the foreign substances in the collection part.

Figure 16:
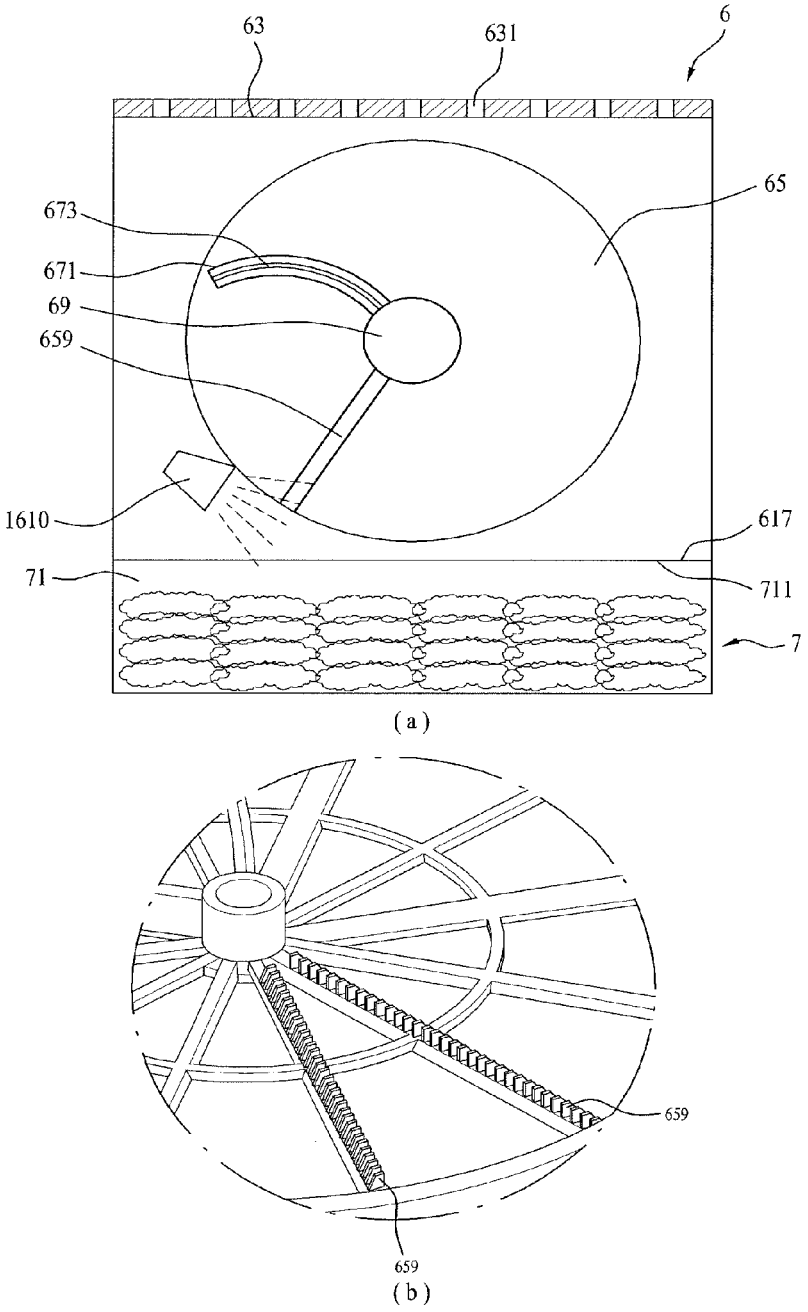
FIGS. 16, 17, 18, and 19 illustrate an example foreign substance compression unit that compresses foreign substances by using steam or water.
Figure 17:
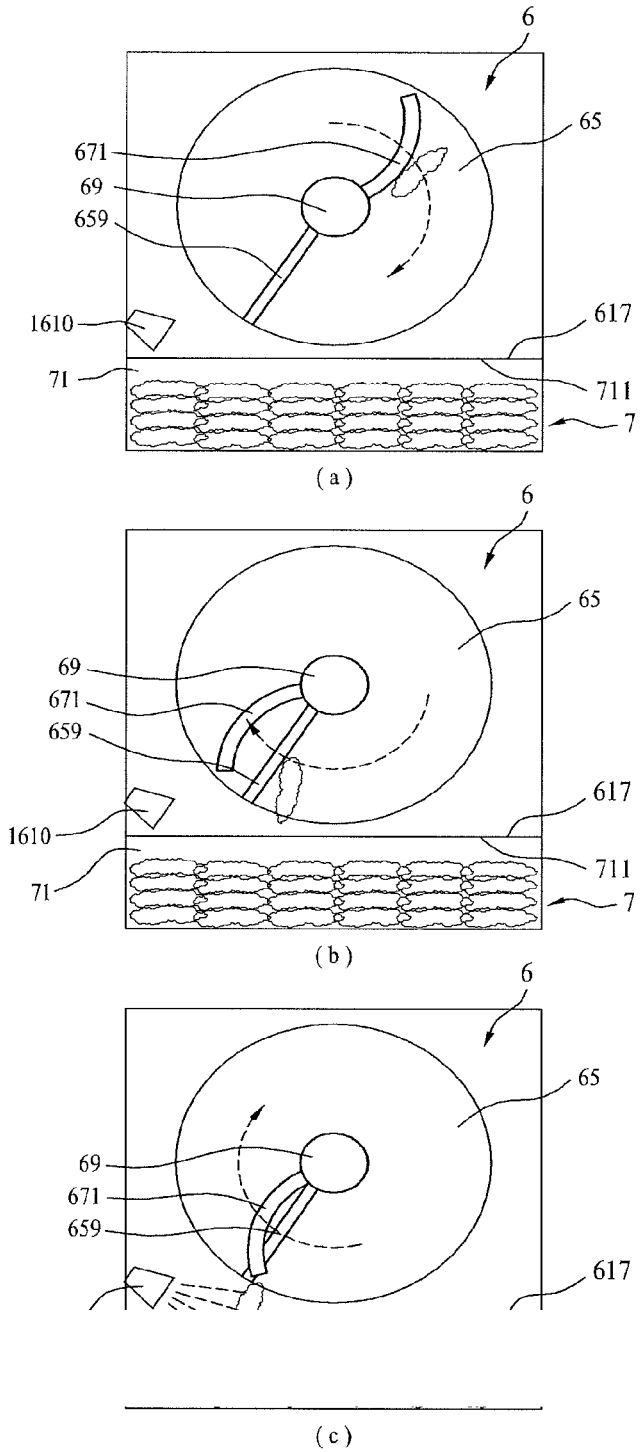

Referring to FIGS. 16 and 17, the compression part 73 can be a nozzle 1610 for spraying water toward the foreign substances separating unit 659. Alternatively, the compression part can be a nozzle 1610 provided to the brush 671 (see, for example, FIG. 18) or a nozzle 1610 provided to the foreign substances separating unit 659 (see, for example, FIG. 19).

Figure 18:
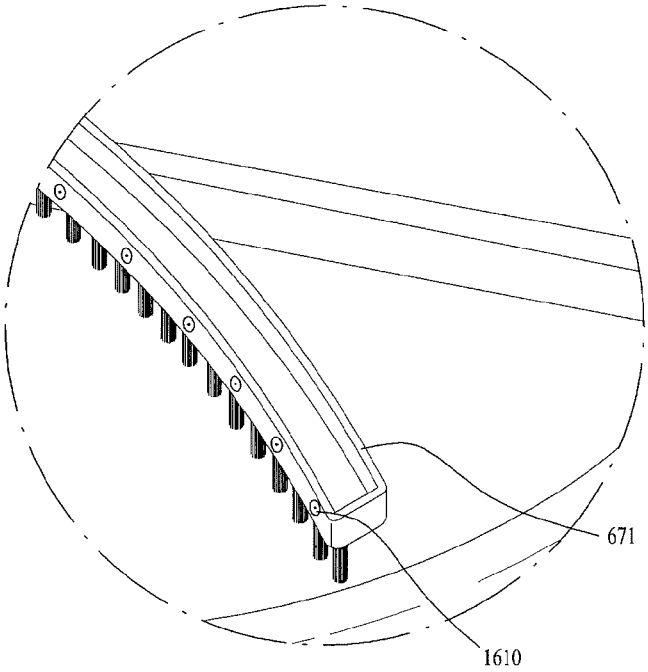
Figure 19:
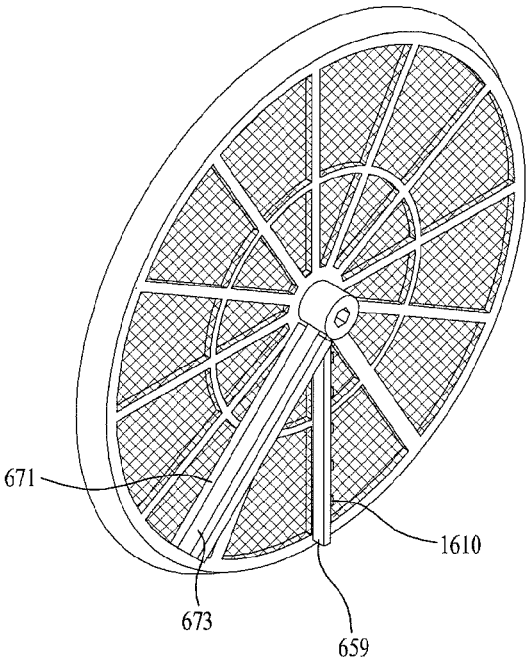

However, the nozzle in FIG. 18 may spray water toward a rotation direction of the brush 671, and the nozzle in FIG. 19 can spray water opposite to a rotation direction of the brush 671.

The water sprayed from the nozzle 1610 can be supplied from a water supply source outside of the clothes treating apparatus, or, in case of the circulating type clothes treating apparatus, the water sprayed from the nozzle 1610 can be supplied from the condensed water from the condensing part.

The operation of the foreign substance compression unit having the above structure will be described with reference to FIG. 17.

However, for convenience's sake, the description will be made with reference to a structure shown in FIG. 16.

Upon putting the clothes treating apparatus into operation, the air is introduced from the accommodating space 2 to an inside of the housing 61 of the filter assembly through the introduction holes 631 in the inflow surface 63.

Since the air introduced to the inside of the housing is supplied to the duct 4 through the filtering unit 65, the foreign substances contained in the air are filtered by the filtering unit 65.

At a preset time after finishing the operation of the clothes treating apparatus or during the operation of the clothes treating apparatus, the control unit controls the brush motor 69, to rotate the brush 671 of the filter assembly (see, for example, FIG. 17A).

Since the brush 671 rotates in contact with the filtering unit 65, the foreign substances remained at the filtering unit 65 move in a direction of the foreign substances separating unit 659, and when the brush passes the foreign substances separating unit 659, the foreign substances remain at the foreign substances separating unit (see, for example, FIG. 17B).

In this instance, the control unit controls the nozzle 1610 to spray water to the foreign substances remained at the foreign substances separating unit (see, for example, FIG. 17C).

Then, the foreign substances wet with the water drop down to the collection part 71 by gravity, and the foreign substances introduced to the collection part are compressed in the collection part by weight of the water.

An inside circumference of the collection part may be coated to limit drying of the foreign substances wet with the water and setting on a bottom of the collection part 71 as time passes.

Figure 20:
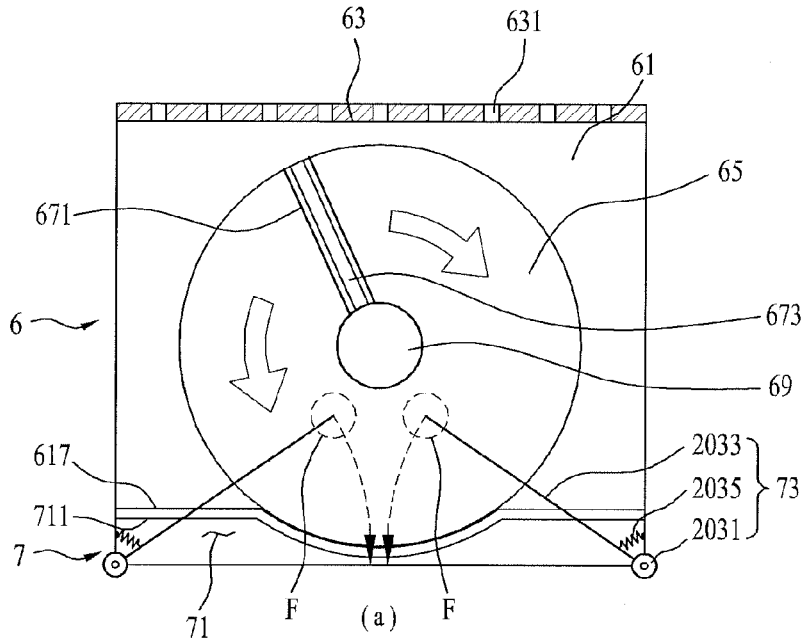
FIGS. 20 and 21 illustrate an example foreign substance compression unit having a compression bar.
Figure 20:
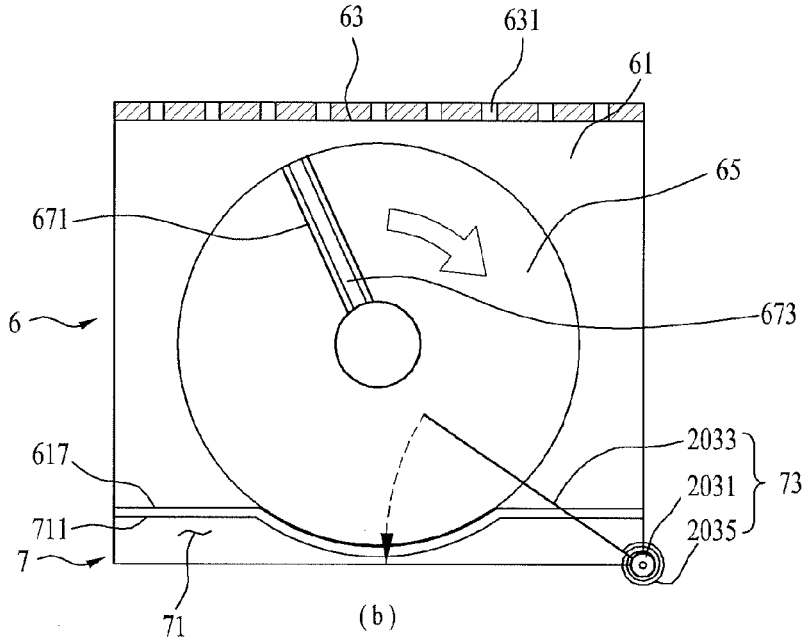
Figure 21:
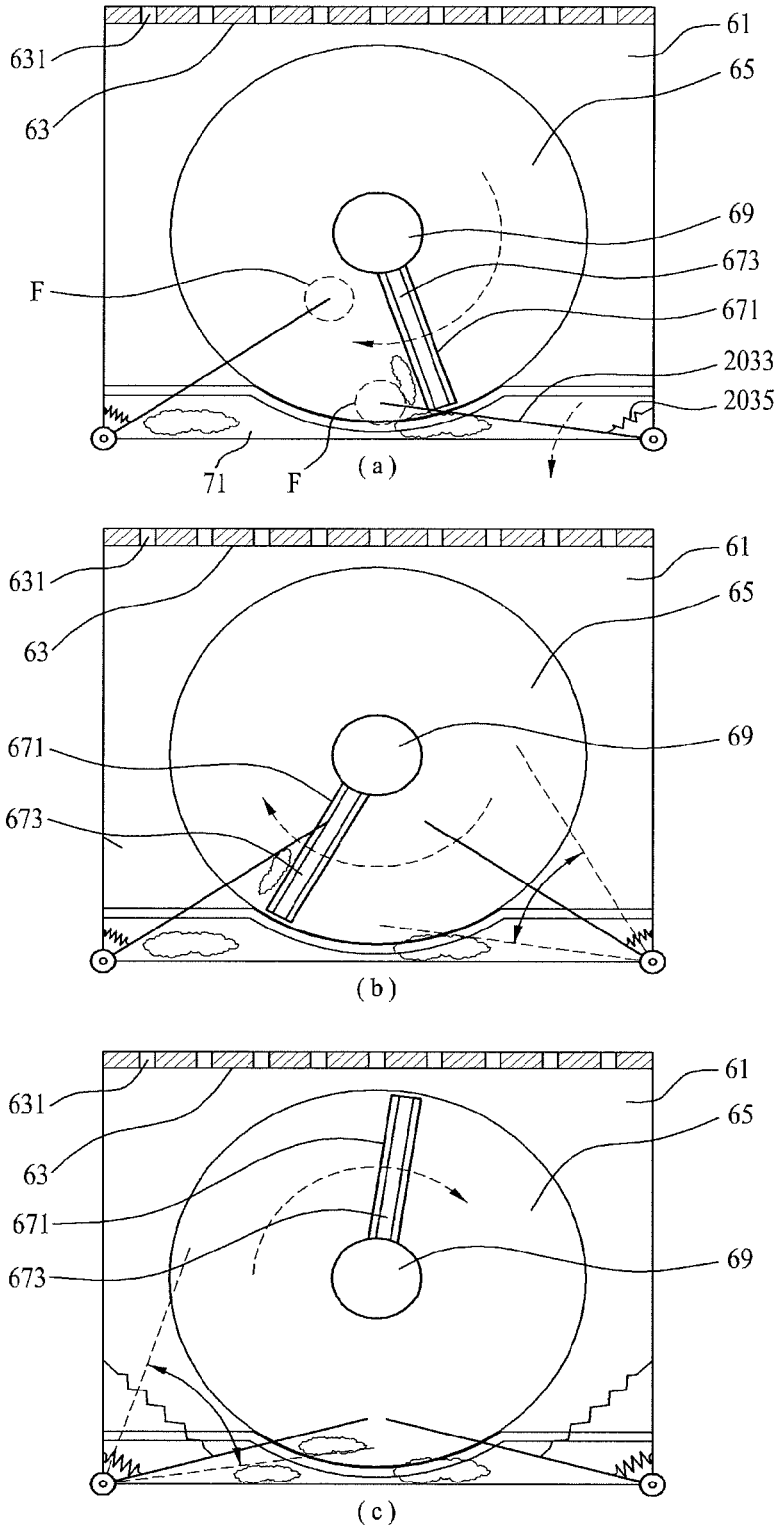

FIGS. 20 and 21 illustrate an example foreign substance compression unit having a compression bar. The compression bar may be used for compressing foreign substances.

The foreign substance compression unit 7 of this implementation includes a collection part 71 for holding the foreign substances from the filter assembly, and a compression bar 2033 coupled to a hinge 2031 in the collection part 71 supported by an elastic member 2035.

The collection part 71 may be in communication with the discharge part 617 of the filter assembly 6 through the opened side 711, and the compression bar 2033 has a free end F positioned at the rotation region of the brush frame 673 provided to the filter assembly 6.

The elastic member 2035 can be a spring connected between the compression bar 2033 and the collection part 71 as shown in FIG. 20, or a coil spring wound around the hinge 2031 for supporting the compression bar as shown in FIG. 20B.

Moreover, the compression part 73 can be provided at opposite ends of the collection part 71, or any one end of the collection part.

The operation of the foreign substance compression unit 7 of this implementation will be described with reference to FIG. 21.

Upon putting the clothes treating apparatus into operation, the air is introduced from the accommodating space 2 to an inside of the housing 61 of the filter assembly through the introduction holes 631 in the inflow surface 63.

Since the air introduced to the inside of the housing thus is supplied to the duct 4 through the filtering unit 65, foreign substances contained in the air are filtered in the filtering unit 65.

At a preset time after finishing the operation of the clothes treating apparatus or during the operation of the clothes treating apparatus, the control unit controls the brush motor 69, to rotate the brush frame 673.

Since the brush 671 provided to the brush frame 673 rotates in contact with the filtering unit 65, at the time the brush frame rotates, the foreign substances remained at the filtering unit 65 move together with the brush 671.

The free end F of the compression bar 2033 is positioned in an inside of the rotation region of the brush frame. Therefore, at the time the brush frame rotates, the compression bar 2033 applies a pressure to a bottom of the collection part 71, to compress the foreign substances held in the collection part 71 (see, for example, FIG. 21A).

And, as the brush frame 673 passes the compression bar 2033, the compression bar 2033 is oscillated by the elastic member 2035, to compress the foreign substances held in the collection part, further.

And, when the brush frame passes the compression bar, the free end F of the compression bar can even separate the foreign substances from the brush to place the foreign substances in the collection part 71 (see, for example, FIG. 21B).

If the foreign substances are not removed from the brush by the free end F of the compression bar, the foreign substances will be removed by the other compression bar 2033.

That is, since the brush frame 673 will keep rotating through the compression bar positioned on a right side, even if the compression bar 2033 positioned on the right side fails to remove the foreign substances from the brush 671, the compression bar on a left side will remove the foreign substances from the brush and compress the foreign substances in the collection part 71 (see, for example, FIGS. 21B and 21C).

A plurality of projections can be provided to a surface of the compression bar 2033 for making easy compression of the foreign substances.

As has been described, the clothes treating apparatus of the present disclosure may have a number of advantages.

For instance, the present disclosure can provide a clothes treating apparatus which is provided with a filter assembly that removes foreign substances from air being discharged from an accommodating space.

The present disclosure can provide a clothes treating apparatus which is provided with a filter assembly that can clean a filter unit thereof, automatically.

The present disclosure can provide a clothes treating apparatus which is provided with a foreign substance compression unit for compressing and holding foreign substances removed from a filtering unit.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An apparatus for treating clothes, the apparatus comprising:

an accommodating space configured to receive one or more clothing articles;

an air supply unit configured to supply air to the accommodating space;

a duct unit configured to guide discharge of air from the accommodating space;

a filter unit positioned to filter substances from air discharged from the accommodating space through the duct unit;

a substance removal unit configured to move substances remaining on a portion of the filter unit;

a collection unit that is separate from the filter unit and the substance removal unit and that is configured to collect substances moved from the filter unit by the substance removal unit;

a compression unit configured to compress substances collected in the collection unit;

a Hall Effect sensor positioned in the collection unit;

a first magnet coupled to the compression unit such that movement of the compression unit can be sensed by the Hall Effect sensor; and a second magnet coupled to the substance removal unit such that movement of the substance removal unit can be sensed by the Hall Effect sensor.

2. The apparatus of claim 1, wherein the substance removal unit comprises a rotating brush.

3. The apparatus of claim 2, further comprising:

a substance separating unit configured to separate the substances from the brush, wherein the compression unit comprises:

a collection part configured to hold the substances, and a nozzle configured to spray water in a direction of the substance separating unit.

4. The apparatus of claim 3, wherein the substance separating unit includes a plurality of projections from a surface of the filtering unit, the plurality of projections being positioned within a rotation region of the brush.

5. The apparatus of claim 1, wherein the compression unit comprises a plate configured to move in the collection unit along a horizontal axis and press substances collected in the collection unit against a side of the collection unit.

6. The apparatus of claim 5, further comprising a driving gear that is configured to move the compression unit along the horizontal axis and rotate the substance removal unit.

7. The apparatus of claim 5, further comprising a first driving gear configured to move the compression unit along the horizontal axis and a second driving gear configured to rotate the substance removal unit.

8. The apparatus of claim 1, wherein the movement of the substance removal unit and the movement of the compression unit occur at different times.

9. The apparatus of claim 8, wherein the substance removal unit is placed in a pre-determined position when not in operation, wherein a stopping position of the substance removal unit at a termination of operation of the substance removal unit is detected by the Hall Effect sensor such that the substance removal unit is re-positioned in the pre-determined position when a stopping position of the substance removal unit is different from the pre-determined position.

10. The apparatus of claim 1, wherein the compression unit includes:

a compression plate configured to move within the collection unit, and a driving motor configured to move the compression plate.

11. The apparatus of claim 1, wherein a bottom of the collection unit comprises mesh such that air is able to flow through the bottom of the collection unit.

12. The apparatus of claim 1, further including an entrance attached to an enclosure of the apparatus, wherein the compression unit is accessible from outside of the apparatus using the entrance, and the compression unit is removable from the enclosure of the apparatus through the entrance.

13. The apparatus of claim 1, further comprising a control unit that is configured to compare a reciprocating period of the compression unit to a predetermined reference period and sense the amount of substances held in the collection unit based on the comparison, and the reciprocating period is detected by the Hall Effect sensor and the first magnet.

14. The apparatus of claim 1, wherein the compression unit further includes:

a compression plate configured to move within the collection unit, a driving motor configured to move the compression plate, and a power transmission unit connected between the driving motor and the compression plate, wherein the sensing unit includes a contact sensor configured to sense a reciprocating period of the compression plate when brought into contact with the compression plate.

* * * * *